US010331086B2

(12) United States Patent
Decoux et al.

(10) Patent No.: US 10,331,086 B2
(45) Date of Patent: Jun. 25, 2019

(54) METHOD AND SYSTEM FOR AUTHENTICATING A TIMEPIECE

(71) Applicant: SICPA HOLDINGS SA, Prilly (CH)

(72) Inventors: Eric Decoux, Vevey (CH); Andrea Callegari, Chavannes-près-Renens (CH); Lorenzo Sirigu, Lausanne (CH)

(73) Assignee: SICPA HOLDING SA, Prilly (CH)

( * ) Notice: Subject to any disclaimer, the term of this patent is extended or adjusted under 35 U.S.C. 154(b) by 1018 days.

(21) Appl. No.: 13/940,767

(22) Filed: Jul. 12, 2013

(65) Prior Publication Data

US 2014/0019089 A1 Jan. 16, 2014

Related U.S. Application Data

(60) Provisional application No. 61/739,381, filed on Dec. 19, 2012.

(30) Foreign Application Priority Data

Jul. 13, 2012 (EP) ..... 12005181

(51) Int. Cl.
*G04D 7/00* (2006.01)
*G04D 7/12* (2006.01)

(52) U.S. Cl.
CPC ..... *G04D 7/002* (2013.01); *G04D 7/1228* (2013.01)

(58) Field of Classification Search
CPC ..... G06K 2009/0059; G06K 9/00577; G04G 21/00; G04G 99/006; G04D 7/002; G04D 7/1228
See application file for complete search history.

(56) References Cited

U.S. PATENT DOCUMENTS 2,782,627 A 2/1957 Hetzel
3,183,706 A 5/1965 Ellison
(Continued)

FOREIGN PATENT DOCUMENTS

CH 694 111 A5 7/2004
CN 86202377 8/1987
(Continued)

OTHER PUBLICATIONS

Paul Altieri, How to Spot a Fake Rolex—The Official Guide, Bobs Watches, Jul. 12, 2010.*
(Continued)

*Primary Examiner* — Kyle R Quigley
(74) *Attorney, Agent, or Firm* — Muncy, Geissler, Olds & Lowe, P.C.

(57) ABSTRACT

A method for authenticating a timepiece including measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, extracting from said electrical signal or from a representation of said electrical signal in a time, frequency or time-frequency domain at least one of a magnitude information on a magnitude of one of said plurality of acoustic events, time information on said one of said plurality of acoustic events, and a frequency information on a frequency of said one of said plurality of acoustic events, comparing said extracted information with at least one of a reference information, and deriving information on an authenticity of said timepiece based on the comparing.

13 Claims, 17 Drawing Sheets

(56) References Cited

U.S. PATENT DOCUMENTS

| | | | | |
|---|---|---|---|---|
| 3,690,144 | A | 9/1972 | Bonny | |
| 3,756,066 | A | 9/1973 | Bolliger | |
| 3,771,347 | A * | 11/1973 | Schar | G04D 7/1207 73/1.45 |
| 3,811,315 | A | 5/1974 | Kunitomi | |
| 3,817,083 | A | 6/1974 | Jucker | |
| 3,864,957 | A | 2/1975 | Fujita | |
| 3,892,124 | A | 7/1975 | Reese | |
| 3,946,592 | A | 3/1976 | Ichikawa | |
| 4,012,941 | A | 3/1977 | Jucker | |
| 4,024,750 | A | 5/1977 | Erickson | |
| 4,028,927 | A | 6/1977 | Kikuyama et al. | |
| 4,078,419 | A | 3/1978 | Busch et al. | |
| 4,078,420 | A | 3/1978 | Reese | |
| 4,083,222 | A | 4/1978 | Stawiski | |
| 4,224,820 | A | 9/1980 | Sitkewich | |
| 4,320,529 | A | 3/1982 | Maeda | |
| 4,452,082 | A | 6/1984 | Miwa | |
| 5,572,488 | A | 11/1996 | Yamada et al. | |
| 5,619,616 | A | 4/1997 | Brady et al. | |
| 7,057,430 | B2 | 6/2006 | Ogiso | |
| 7,605,372 | B2 | 10/2009 | Hachin | |
| 7,979,731 | B2 | 7/2011 | Futa | |
| 2003/0112708 | A1 | 6/2003 | Fujisawa et al. | |
| 2004/0113819 | A1 | 6/2004 | Gauthey et al. | |
| 2006/0293606 | A1 | 12/2006 | Tomita | |
| 2009/0278670 | A1 | 11/2009 | Karapatis | |
| 2010/0080086 | A1 * | 4/2010 | Wright | H04B 11/00 367/191 |
| 2011/0110200 | A1 | 5/2011 | Goeller | |
| 2013/0170327 | A1 | 7/2013 | Peters et al. | |
| 2014/0013846 | A1 | 1/2014 | Decoux et al. | |
| 2014/0013847 | A1 | 1/2014 | Decoux et al. | |
| 2015/0013460 | A1 | 1/2015 | Favre | |
| 2015/0053006 | A1 | 2/2015 | Decoux et al. | |
| 2015/0053007 | A1 | 2/2015 | Decoux et al. | |

FOREIGN PATENT DOCUMENTS

| | | | |
|---|---|---|---|
| CN | 101344756 | | 1/2009 |
| DE | 103 38932 | A1 | 3/2005 |
| EP | 0 072 350 | A1 | 2/1983 |
| EP | 1 021 790 | A1 | 7/2000 |
| FR | 2767205 | | 10/1999 |
| FR | 2 957 689 | A1 | 9/2011 |
| JP | 05264335 | | 10/1993 |
| JP | 2010259629 | | 11/2010 |
| WO | WO99/19831 | A1 | 4/1999 |
| WO | WO99/21061 | A1 | 4/1999 |

OTHER PUBLICATIONS

M. Disher, "An Overview of the COSC Certificate and Testing Procedures," pp. 1-4, dated Feb. 12, 2000.

Search Report and Written Opinion in related International Application No. PCT/EP2013/064865, dated Aug. 21, 2013.

Chinese office action in counterpart Chinese Application No. CN2013800355657 dated Aug. 1, 2016 (and English language translation).

Chinese office action in counterpart Chinese Application No. 201380035565.7 dated Mar. 7, 2017 (and English language translation).

* cited by examiner

METHOD AND SYSTEM FOR AUTHENTICATING A TIMEPIECE

CROSS REFERENCE TO RELATED APPLICATIONS

The present application claims priority to U.S. Provisional Application No. 61/739,381 filed on Dec. 19, 2012, and to European Patent Application No. 12005181.8 filed on Jul. 13, 2012, the disclosures of which are expressly incorporated by reference herein in their entireties.

FIELD OF THE INVENTION

The present invention relates to a method and system for authenticating a timepiece, in particular a watch.

BACKGROUND OF THE INVENTION

Counterfeit consumer goods, commonly called knock-offs, are counterfeit or imitation products offered for sale. The spread of counterfeit goods has become global in recent years and the range of goods subject to counterfeiting has increased significantly.

Expensive watches (and spare parts for watches) are vulnerable to counterfeiting, and have been counterfeited for decades. A counterfeit watch is an unauthorized copy of a part or all of an authentic watch. According to estimates by the Swiss Customs Service, there are some 30 to 40 million counterfeit watches put into circulation each year. It is a common cliché that visitors to New York City are approached on the street by vendors with a dozen such counterfeit watches inside their coats, offered at bargain prices. Extremely authentic looking, but very poor quality counterfeit watches with self-winding mechanisms and fully working movements can sell for as little as twenty dollars. The problem is becoming more and more serious, with the quality of the counterfeits constantly increasing. For example, some counterfeits' movements and materials are of remarkably passable quality and may look good to the untrained eye and work well for some years, a possible consequence of increasing competition within the counterfeiting community. Counterfeit watches cause an estimated $1 Billion loss per year to the watch industry.

Authentication solutions that have been used for protection of consumer goods from counterfeiting are often based on marking the item with a specific material, code, or marking, engraving, etc. However, these methods modify the nature and the appearance of the object, and this is often not acceptable in the watch (and other luxury items) industry, where the design of the object and its visual appearance is of paramount importance. Also, these methods require an active intervention at the time of manufacturing and, correspondingly an important change of the production process.

Counterfeiters often focus on the outer appearance of the watch and fit a cheap movement inside, because the potential buyer tends to focus more on the outward appearance of the piece, and because good movements are expensive. Even when a good quality movement is used, it is very difficult and expensive to make an exact copy, and thus, the counterfeiter will prefer to use a movement that is easier to obtain and/or easier to manufacture. It is, therefore, desirable, when assessing the authenticity of a timepiece, to have as much information as possible not only on its outer appearance but also on its inner content. It is furthermore desirable not to have to open the timepiece when checking the authenticity, as the operation requires specialized equipment and procedures, which may impact on the performance and/or integrity of the piece (e.g., water tightness), and which may invalidate the manufacturer's warranty.

It is, therefore, desirable to be able to authenticate a timepiece in a manner that is as non-invasive and as reliable as possible without having to open the timepiece.

SUMMARY OF EMBODIMENTS OF THE INVENTION

An aim of the invention is to provide a method for authenticating a timepiece that is non-invasive and reliable.

This aim is solved by the subject matter of the independent claims. Preferred embodiments are subject matter of the dependent claims.

One embodiment of the invention provides a method for authenticating a timepiece comprising measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place within said timepiece, extracting in the electrical signal or in a representation of the electrical signal in a time, frequency or time-frequency domain at least one of magnitude information on a magnitude of one of the plurality of acoustic events, time information on said one of the plurality of acoustic events, and frequency information on a frequency of said one of the plurality of acoustic events, comparing the extracted at least one of a magnitude information, time information and frequency information with at least one of a reference magnitude information, reference time information and reference frequency information, and deriving information on authenticity of the timepiece based on the comparison.

According to an embodiment of the invention, said extracting comprises extracting, in a time sequence of said electrical signal corresponding to one of said plurality of acoustic events, amplitude information on an amplitude of a first acoustic sub-event of said one of said plurality of acoustic events.

According to an embodiment, the extracting comprises separating a series of consecutive events $E_i$ with i=1 . . . n into different classes and analyzing each class separately. As an example, one class may correspond to odd events (i=1, 3, 5, . . . ) and another to even events (i=2, 4, 6, . . . ), which amounts to separating ticks and tocks. More generally, classes may contain events with the same value of (i modulo p), where (i modulo p) is the remainder of integer division of i by p and p is an integer number. For example, when p is equal to twice the number of teeth of the escapement wheel, each class contains the events (ticks or tocks) associated with one specific escapement wheel tooth.

According to an embodiment of the invention, said extracting comprises extracting, in a time sequence of said electrical signal corresponding to one of said plurality of acoustic events, time delay information on a time delay between a first acoustic sub-event of said one of said plurality of acoustic events and a second acoustic sub-event of said one of said plurality of acoustic events.

According to an embodiment of the invention, the method further comprises performing a transform of said electrical signal into a frequency domain to obtain a frequency-domain power spectrum indicating a variation of a power of said electrical signal as a function of frequency, wherein said extracting comprises extracting frequency information based on a frequency associated with a peak of said frequency-domain power spectrum.

According to an embodiment of the invention, said transform of said electrical signal into a frequency domain is a Fourier transform, preferably a Fast Fourier transform.

According to a further embodiment of the invention, the method further comprises performing a transform of said electrical signal into a time-frequency representation indicating frequency information of said electrical signal as a function of time, wherein said extracting comprises extracting at least one of frequency information and time information in said time-frequency representation of said electrical signal.

According to an embodiment of the invention, the transform of the electrical signal into a time-frequency representation is one of a short-time Fourier transform, a Gabor transform, a Wigner transform, and a wavelet transform.

According to an embodiment of the invention, the method further comprises separating every other acoustic event in the electrical signal and performing the method on an electrical signal comprising only every other acoustic event.

According to an embodiment of the invention, the method further comprises encoding the extracted at least one of a magnitude information, time information and frequency information to create a unique identifier for the timepiece, the unique identifier for the timepiece being used as said at least one of reference magnitude information, reference time information and reference frequency information.

Another embodiment of the invention provides a computer readable medium for storing instructions, which, upon being executed by a processor of a computer device, cause the processor to execute a method comprising measuring acoustic vibrations emitted by a timepiece to obtain an electrical signal, said electrical signal indicating a variation of a magnitude of the measured acoustic vibrations as a function of time, wherein the electrical signal comprises a plurality of acoustic events associated with mechanical shocks taking place in said timepiece, extracting in the electrical signal or in a representation of the electrical signal in a time, frequency or time-frequency domain at least one of magnitude information on a magnitude of one of said plurality of acoustic events, time information on said one of said plurality of acoustic events, and frequency information on a frequency of said one of said plurality of acoustic events, comparing said extracted at least one of magnitude information, time information and frequency information with at least one of a reference magnitude information, reference time information and reference frequency information, and deriving an information on an authenticity of said timepiece based on the comparing.

The invention is not necessarily limited to the analysis of ticks alone or tocks alone, it could also be a combination of tick and tock thereof, can be used.

Additional aspects of the present invention are directed to a system for authenticating a timepiece. The system comprises a measuring tool configured to measure acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece. The system additionally comprises an extraction tool configured to extract from said electrical signal or from a representation of said electrical signal in a time, frequency or time-frequency domain at least one of: magnitude information on a magnitude of one of said plurality of acoustic events, time information on said one of said plurality of acoustic events, and frequency information on a frequency of said one of said plurality of acoustic events. The system further comprises an identification tool configured to create an identification code based on said at least one of the magnitude information, the time information and the frequency information.

In certain embodiments, the system further comprises a comparison tool configured to compare said identification code with at least one stored identification code and an authenticity determination tool configured to determine an authenticity of said timepiece based on a result of the comparison tool.

Additional aspects of the present invention are directed to a method for generating an identifier for a timepiece. The method comprises measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece. The method further comprises extracting from said electrical signal or from a representation of said electrical signal in a time, frequency or time-frequency domain at least one of: magnitude information on a magnitude of one of said plurality of acoustic events, time information on said one of said plurality of acoustic events, and frequency information on a frequency of said one of said plurality of acoustic events using a processor of a computing device. The method additionally comprises creating an identification code based on said at least one of the magnitude information, the time information and the frequency information.

In further embodiments, the method further comprises storing the identification code in a storage system.

Additional aspects of the present invention are directed to a method for generating an identifier for a timepiece. The method comprises measuring acoustic vibrations emitted by said timepiece to obtain an electrical signal, and extracting from the electrical signal at least one of: magnitude information on a magnitude of one of said plurality of acoustic events, time information on said one of said plurality of acoustic events, and frequency information on a frequency of said one of said plurality of acoustic events using a processor of a computing device. The method additionally comprises creating an identification code based on said at least one of the magnitude information, the time information and the frequency information.

In additional embodiments, the measured acoustic vibrations emitted by said timepiece comprise one of: a plurality of consecutive tics and tocks, a plurality of consecutive tics, and a plurality of consecutive tocks.

Additional aspects of the present invention are directed to a method for authenticating an item. The method comprises measuring acoustic vibrations emitted by the item to obtain an electrical signal, extracting from the electrical signal at least one of: magnitude information on a magnitude of one of said plurality of acoustic events, time information on said one of said plurality of acoustic events, and frequency information on a frequency of said one of said plurality of acoustic events using a processor of a computing device, and creating an identification code based on said at least one of the magnitude information, the time information and the frequency information.

In additional embodiments, the method further comprises comparing the identification code with at least one reference identification code, and determining an authenticity of the item based on the comparing.

In further embodiments, the method also comprises comparing the at least one of the magnitude information, the time information and the frequency information with at least one of reference magnitude information, reference time information and reference frequency information, and determining an authenticity of the item based on the comparing.

In certain embodiments, the item comprises a timepiece.

More particularly, the timepiece can comprise a watch.

In additional embodiments, the electrical signal indicates a variation of a magnitude of the measured acoustic vibrations as a function of time, and the electrical signal comprises the plurality of acoustic events associated with mechanical shocks taking place in the item.

In further embodiments, the extracting from the electrical signal comprises extracting from the electrical signal or from a representation of the electrical signal in one of a time domain, frequency domain and time-frequency domain, at least one of: the magnitude information, the time information, and the frequency information.

In additional embodiments, the extracting further comprises extracting, in a time sequence of the electrical signal corresponding to one of the plurality of acoustic events, amplitude information on an amplitude of a first acoustic sub-event of said one of said plurality of acoustic events.

In yet further embodiments, the extracting further comprises extracting, in a time sequence of said electrical signal corresponding to one of said plurality of acoustic events, time delay information on a time delay between a first acoustic sub-event of said one of said plurality of acoustic events and a second acoustic sub-event of said one of said plurality of acoustic events.

In further embodiments, the method also includes performing a transform of said electrical signal into a frequency domain to obtain a frequency-domain power spectrum indicating a variation of a power of said electrical signal as a function of frequency, wherein said extracting further comprises extracting at least one frequency information on a frequency associated with a peak of said frequency-domain power spectrum.

In additional embodiments, the method also includes performing a transform of the electrical signal into a time-frequency representation indicating frequency information of the electrical signal as a function of time, wherein the extracting further comprises extracting at least one of the frequency information and the time information in the time-frequency representation of the electrical signal.

In further embodiments, the method also includes issuing a signal indicating one of authenticity of the timepiece and non-authenticity of the timepiece.

In additional embodiments, the signal comprises at least one of: an alert, a hold signal, an alarm, and a notification.

BRIEF DESCRIPTION OF THE FIGURES

For a more complete understanding of the invention, as well as other objects and further features thereof, reference may be had to the following detailed description of the invention in conjunction with the following exemplary and non-limiting drawings wherein.

Figure 1:
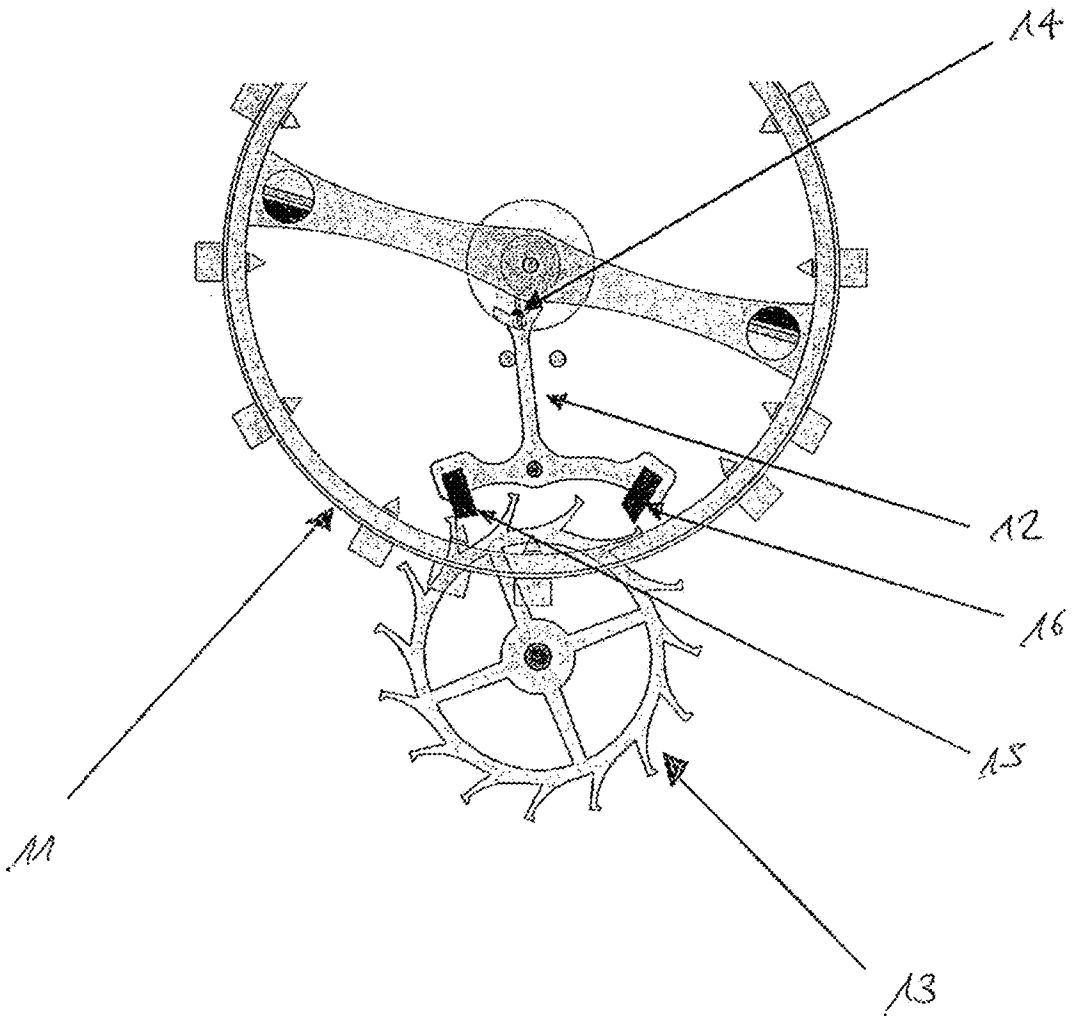
FIG. 1 is a schematic representation of an escapement in a timepiece.

Reference numbers refer to the same or equivalent parts of the present invention throughout the various figures of the drawings.

DETAILED DESCRIPTION OF EMBODIMENTS OF THE INVENTION

In the following description, the various embodiments of the present invention will be described with respect to the enclosed drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range. For example, if a range is from about 1 to about 50, it is deemed to include, for example, 1, 7, 34, 46.1, 23.7, or any other value or range within the range.

The various embodiments disclosed herein can be used separately and in various combinations unless specifically stated to the contrary.

A timepiece, such as a watch, comprises a mechanical movement which produces a characteristic noise, which is commonly referred to as tick-tock. This tick-tock sound, which is characteristic of a timepiece, is due to the impacts occurring between the various mechanical parts of the escapement of the timepiece, which is a device transferring energy to the time-keeping element, the so-called impulse action, and allowing the number of its oscillations to be counted, the locking action. The ticking sound is the sound of the gear train stopping at the escapement locks.

FIG. 1 shows a representation of the main parts of an escapement. An escapement comprises a balance wheel 11, a pallet fork 12 and an escapement wheel 13. The balance wheel 11 comprises an impulse pin 14, which strikes against the pallet fork 12. Further, the escapement wheel 13 comprises teeth that are arranged to strike an entry pallet jewel 15 and an exit pallet jewel 16 of the pallet fork 12.

According to an embodiment of a method for authenticating a timepiece according to the invention, the acoustic vibrations of a timepiece to be authenticated are measured, for instance using a microphone, preferably a contact piezoelectric microphone. The acoustic vibrations emitted by the timepiece are measured and an electrical signal is obtained, which indicates a variation of the magnitude of the measured acoustic vibrations as a function of time. Such an electrical signal is represented in FIGS. 2 to 4.

Figure 2:
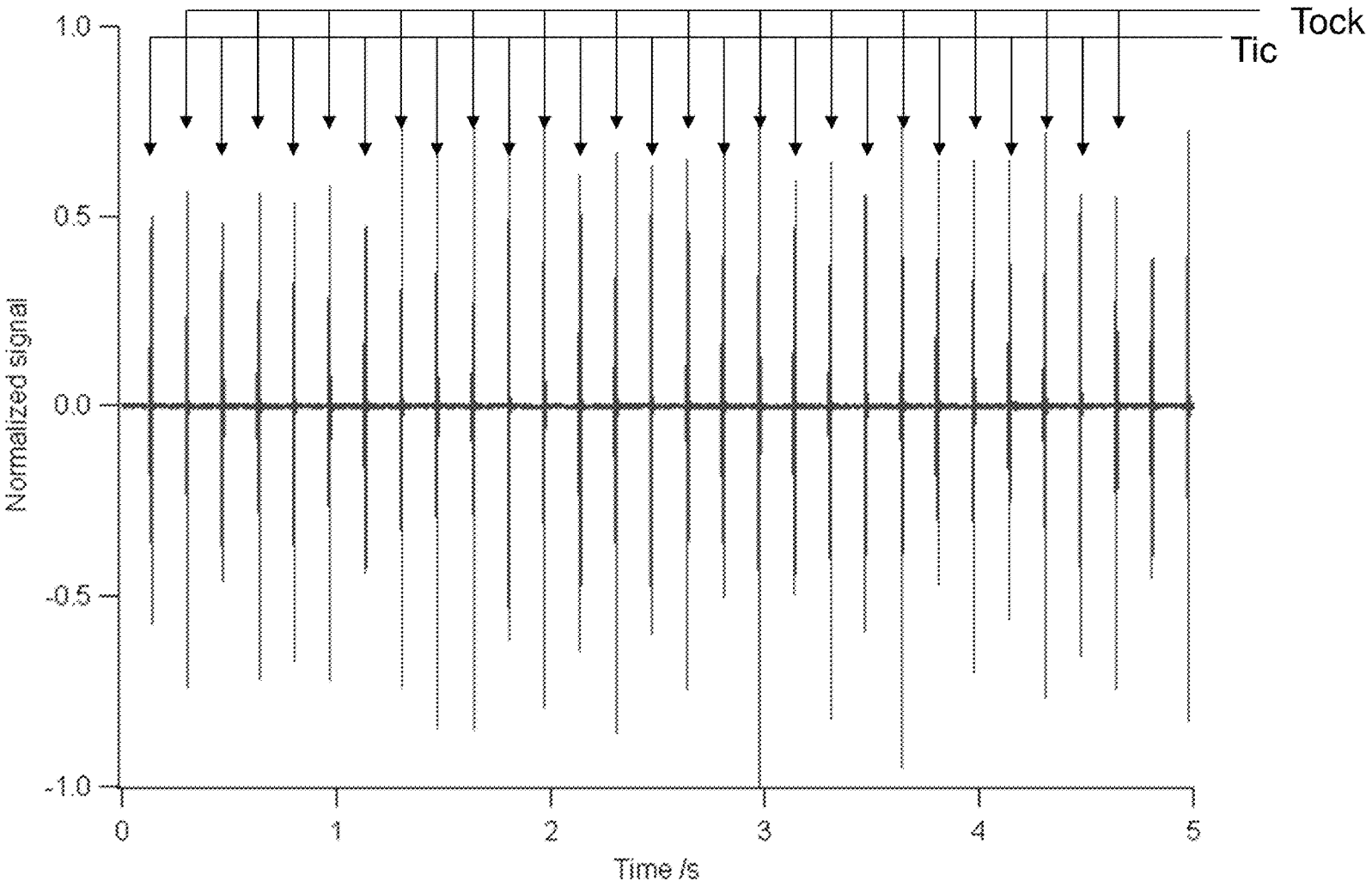
FIG. 2 is a representation of acoustic vibrations in a timepiece as a function of time.

FIG. 2 represents the acoustic vibrations emitted by a timepiece as a function of time. The represented signal has a frequency of 3 Hz, i.e., six beats take place every single second. The signal alternates between tick events and tock events.

Figure 3:
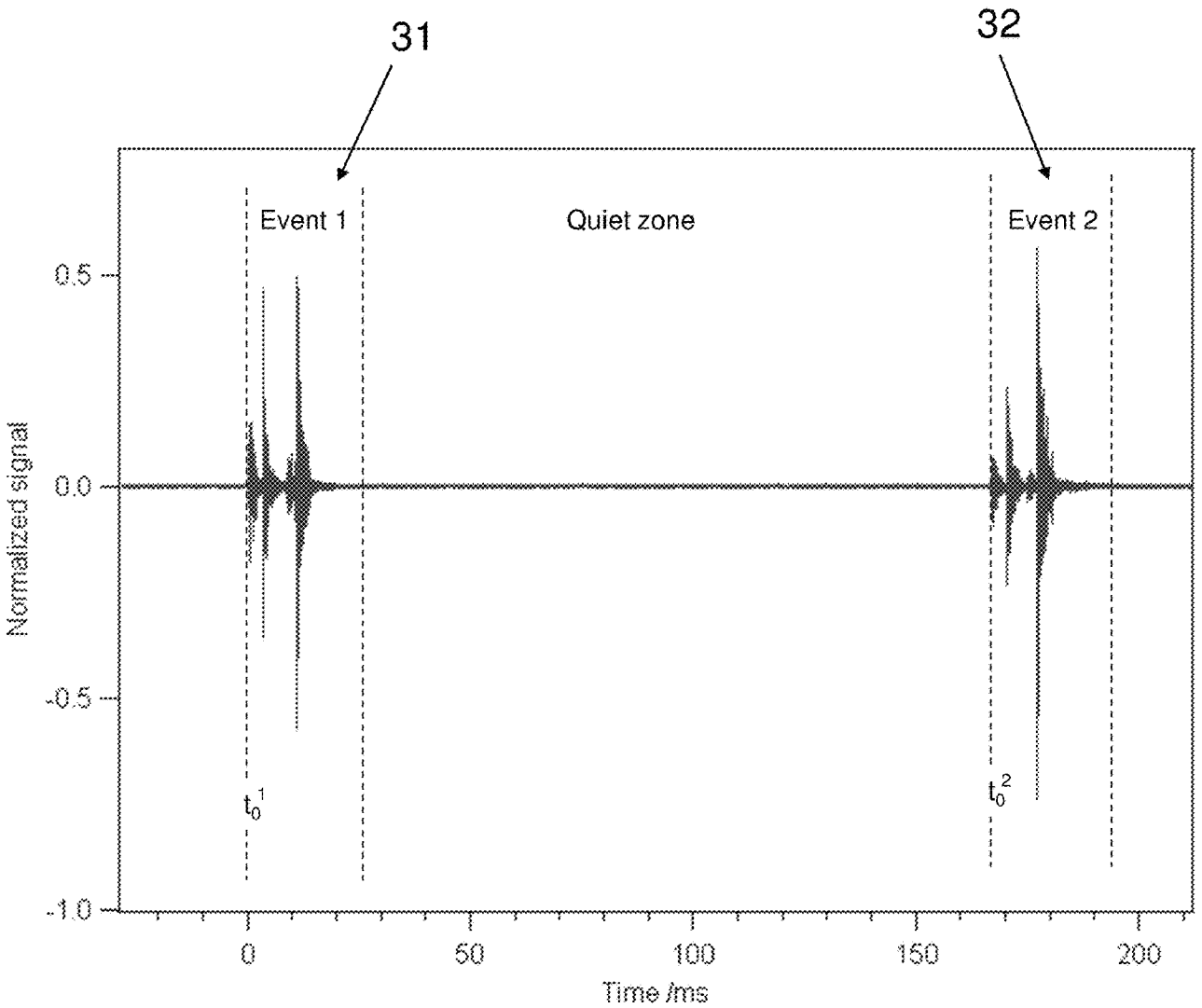
FIG. 3 is a close-up view of two events in the time sequence represented in FIG. 2.

FIG. 3 represents a closer view on the start of the sequence of tick events and tock events shown in FIG. 2. FIG. 3 shows a first event 31 and a second event 32 of the sequence of ticks and tocks of FIG. 2. The first event 31 spreads in a time range comprised between about 0 and 15 ms, while the second event 32 spreads in a time range comprised between about 165 ms and 185 ms. As can be seen from FIG. 3, each one of the first event 31 and second event 32 is itself a sequence of several sub-events, which are illustrated in more detail in FIG. 4.

Figure 4:
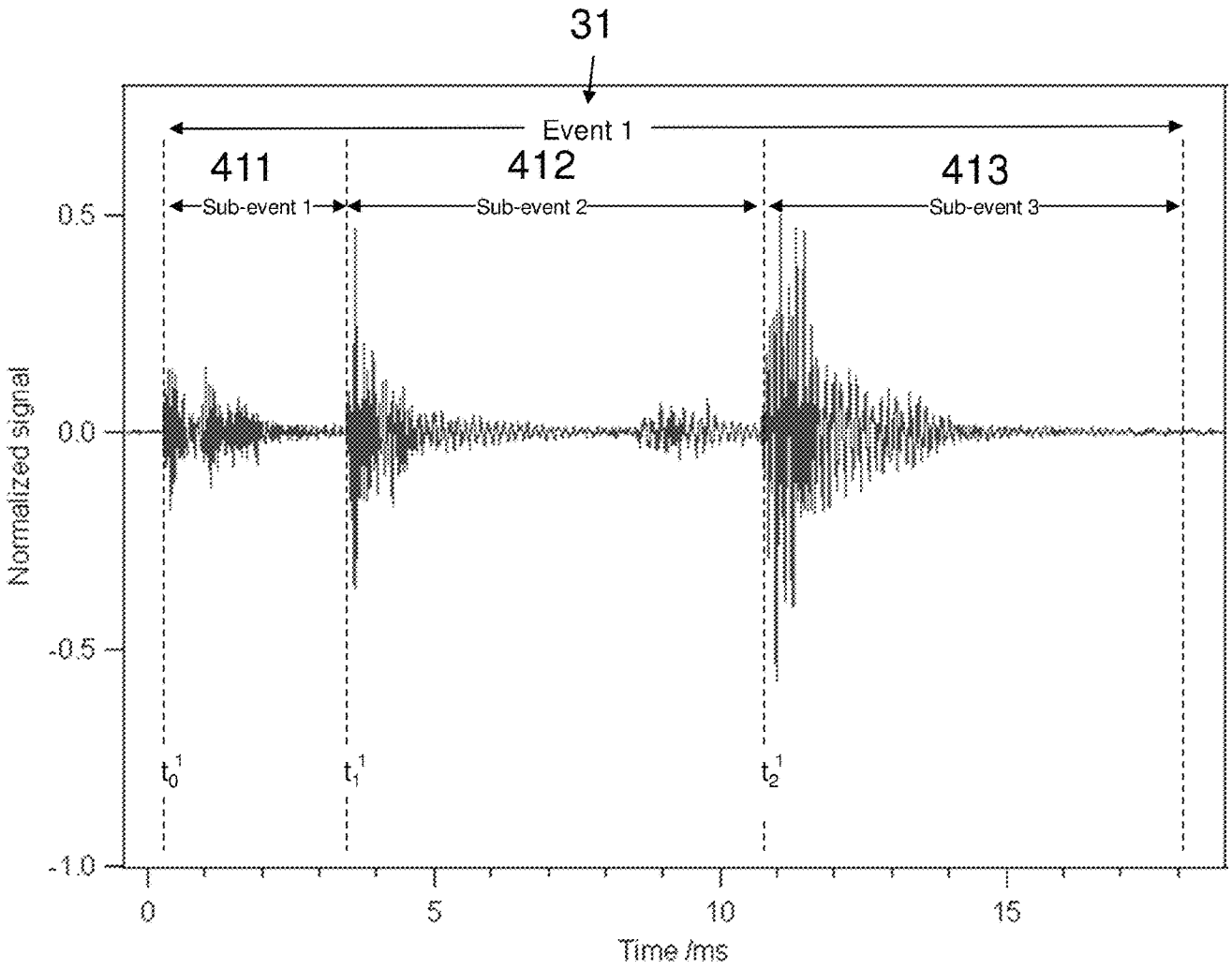
FIG. 4 is a close-up view of the first event represented in FIG. 3.

FIG. 4 shows a close-up view on the first event 31 in the representation of FIG. 3. The first event 31 comprises a first sub-event 411, a second sub-event 412 and a third sub-event 413. The first sub-event 411 takes place in a time range comprised between about 0 and 3 ms, the second sub-event 412 takes place in a time range comprised between about 3.5 ms and about 10.5 ms. The third sub-event 413 takes place in a time range comprised between about 10.5 ms and about 18 ms. The first sub-event 411, second sub-event 412 and third sub-event 413 therefore make up the first event 31 shown in FIG. 3, which corresponds to one acoustic event of the timepiece.

Figure 5:
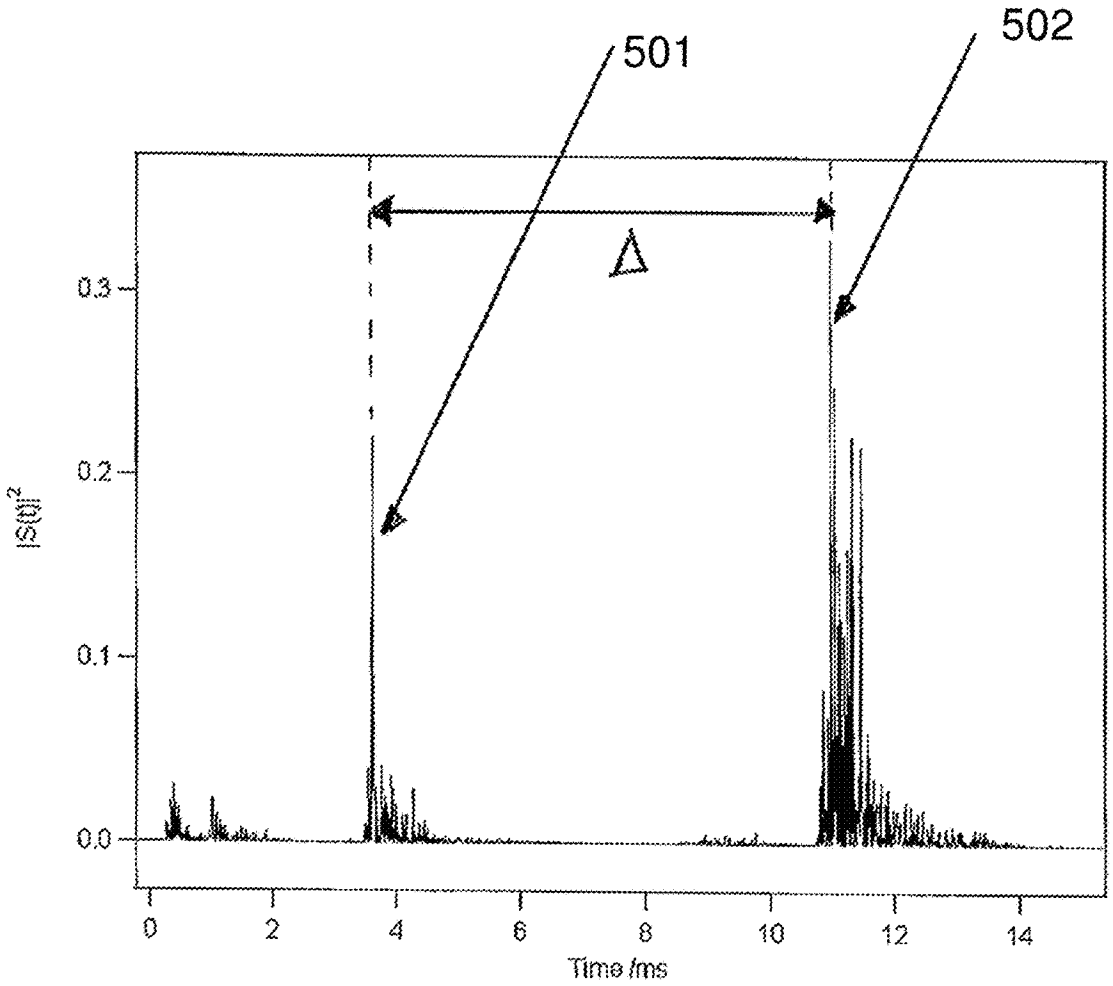
FIG. 5 illustrates a first embodiment of a method for authenticating a timepiece according to the invention.

FIG. 5 illustrates a first embodiment of a method for authenticating a timepiece according aspects of the present invention. FIG. 5 is a representation of the instantaneous power of the acoustic vibrations emitted by a timepiece to be authenticated as a function of time. According to a first embodiment of a method for authenticating a timepiece according to the invention, the acoustic vibrations emitted by the timepiece are measured and an electrical signal is obtained. The electrical signal indicates a variation of the magnitude of the measured acoustic vibrations as a function of time. In the first embodiment illustrated with respect to FIG. 5, this electrical signal is the representation of the instantaneous power of the acoustic vibrations as a function of time.

According to the first embodiment of the present invention, amplitude information of one or more events of a series of events is extracted from the representation of the instantaneous power of the measured acoustic vibrations. In particular, an amplitude of a sub-event within one event is extracted. The extracted amplitude information could be peak amplitude or average amplitude. In certain embodiments, the extracted amplitude information is a relative amplitude, since it depends on how the signal has been normalized.

FIG. 5 shows a first sub-event 501 and a second sub-event 502. The first sub-event 501 takes place in a time range comprised between about 3.5 ms and 4.5 ms, while the second sub-event 502 takes place in a time range comprised between about 11 ms and about 13 ms. The extracted amplitude is a beat-to-beat variation of a sub-event, e.g., the first sub-event 501. Further, an amplitude of the second sub-event 502 may be extracted.

The extracted amplitude information is then compared with reference amplitude information. This reference amplitude information has been previously measured and stored for the timepiece model, which is to be authenticated. By comparing the extracted amplitude information obtained for the timepiece to be authenticated with the reference amplitude information, information regarding an authenticity of the timepiece to be authenticated can be derived.

In particular, from the average amplitudes $A_1 \ldots A_n$ of a series of events 1 to n, information on the number of teeth of the escapement wheel can be obtained, as well as the number of teeth on the escapement wheel pinion and on further wheels down the gear train. This information can be used for authentication purposes.

According to a second possibility of the first embodiment of the present invention, instead of amplitude information, time-delay information may be extracted from the time sequence of the measured acoustic vibrations of the timepiece. For instance, one or more time delay(s) Δ between the highest peak of the first sub-event 501 and the highest peak of the second sub-event 502 may be extracted. This time delay Δ obtained for the timepiece to be authenticated can then be compared with a reference time delay which has been previously stored for the timepiece model to be authenticated. The time delay may be an absolute time delay or a relative time delay. For example, referring to FIG. 4, (t2−t1)/(t1−t0) is a relative time delay. The ratio of (t1−t0) in event i to (t1−t0) in event j is also a relative time delay. This information can also be used for authentication purposes.

According to a preferred embodiment of the invention, which may apply to the first embodiment of the invention, but also to the further embodiments, which will be outlined in the following description, the measurements of the acoustic vibrations of the timepiece are carried out on every other acoustic event in the obtained electrical signal. This means that every other acoustic event in the electrical signal is separated, e.g., only the "ticks" or the "tocks" of the electrical signal are separated, and the steps of the method for authenticating a timepiece according to an embodiment of the present invention are performed on an electrical signal comprising only every other acoustic event, e.g., only the "ticks" or the "tocks." More generally, the acoustic events may be separated according to any subset, not only every other acoustic event, but every n event, where n is equal to 2, 3, 4, 5, etc. Separating every other acoustic event corresponds to the case of n equal to 2 and represents a preferred embodiment of the present invention.

Figure 6:
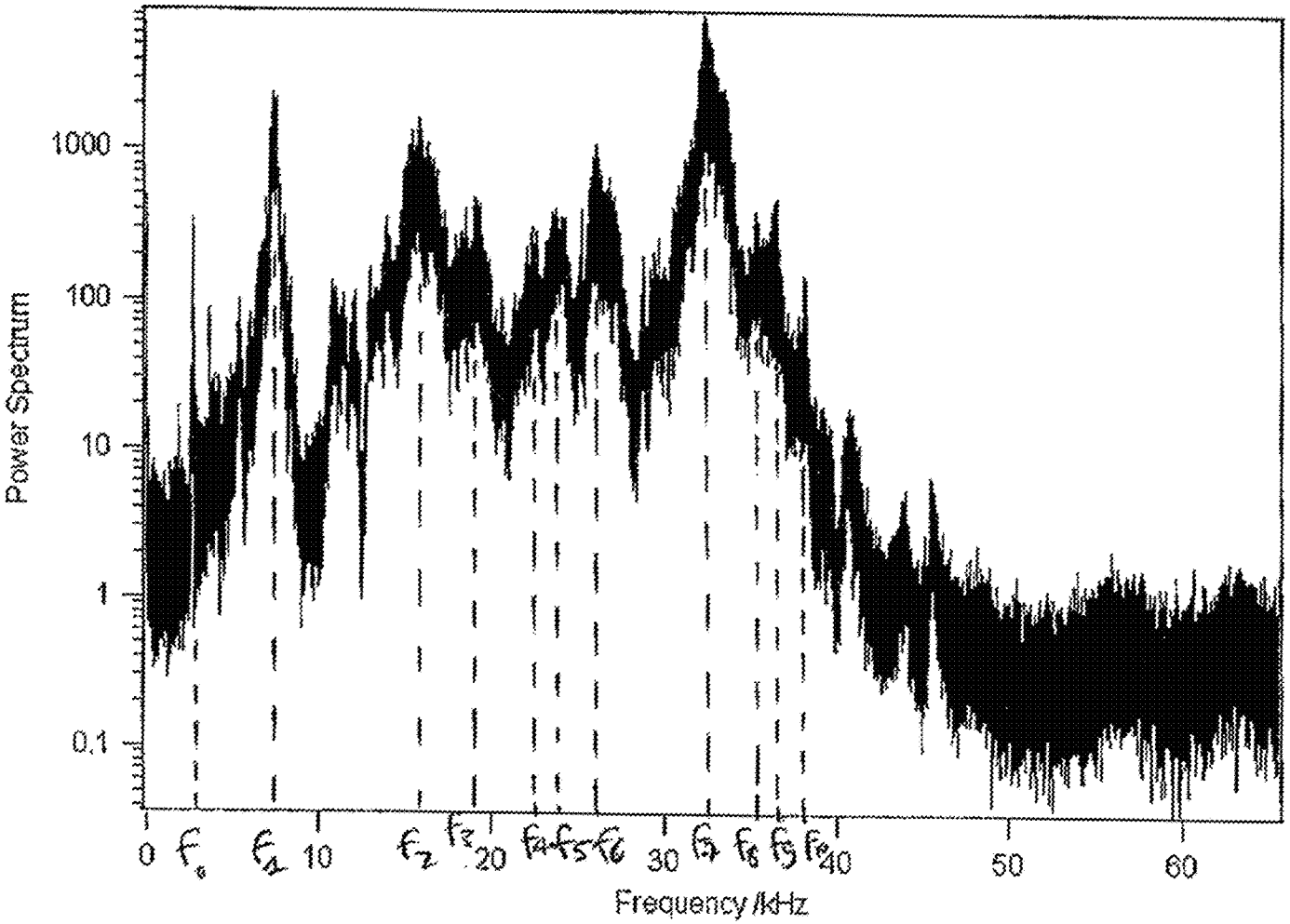
FIG. 6 illustrates a second embodiment of a method for authenticating a timepiece according to the invention.

FIG. 6 illustrates a second embodiment of a method for authenticating a timepiece according to the present invention. FIG. 6 is a representation of the power spectrum of the measured acoustic vibrations emitted by a timepiece to be authenticated as a function of frequency. According to the second embodiment of the invention, the acoustic vibrations emitted by a timepiece to be authenticated are measured and an electrical signal is obtained, which indicates a variation of a magnitude of the measured acoustic vibrations as a function of time. This electrical signal is transformed into a frequency domain, so as to obtain a frequency-domain power spectrum indicating a variation of a power of the electrical signal as a function of frequency. The frequency-domain transform to be used according to this embodiment may be one of the usual frequency-domain transforms, such as a Fourier transform, in particular a Fast Fourier transform.

The frequency-power spectrum of the measured acoustic vibrations of the timepiece to be authenticated reveals several peaks in the power spectrum representation at several frequencies. In the particular example represented in FIG. 6, eleven peaks can be identified in the power spectrum, the power spectrum value of which is larger than 100 on the logarithmic scale of FIG. 6. These peaks in the power spectrum can be identified at frequencies $f_0$, to $f_{10}$, which are comprised in the range between 0 and 40 kHz. It must be noted that these values are given for illustrative purposes only and are not limiting. In particular, even though the particular example of a threshold set at 100 for identifying peaks in the power spectrum has been given, the person skilled in the art will immediately understand that another threshold may be set, depending on the amount of frequency peaks desired as frequency information. For instance, the threshold could be set at 1000, so that only a few peaks can be identified.

This frequency information, i.e., the respective frequencies $f_0$, to $f_{10}$ in the example of FIG. 6 corresponding to peaks in the frequency-domain power spectrum of the measured acoustic vibrations of the timepiece to be authenticated, is extracted from the frequency-domain power spectrum and compared with reference frequency information, which has been previously stored for the timepiece model. This comparison enables derivation of information making it possible to authenticate a timepiece to be authenticated by simply comparing the frequency information obtained for the timepiece to be authenticated with the reference frequency information for the timepiece model to be authenticated.

According to an embodiment of the present invention, information on the width of the spectral peak can also be used for authentication and/or identification purposes.

According to another embodiment of the present invention, the spectrum may be the average of several spectra. For example, it can be either the average of a number of consecutive events or the average of a number of events from the same class.

In the frequency-domain power spectrum representation of the measured acoustic vibrations emitted by the timepiece to be authenticated, the dominant contribution within the power spectrum comes from the loudest portions within the measured acoustic vibrations emitted by the timepiece to be authenticated. These loudest portions of the acoustic vibrations correspond to the events and sub-events, for example, as represented in FIGS. 3 and 4.

Figure 7:
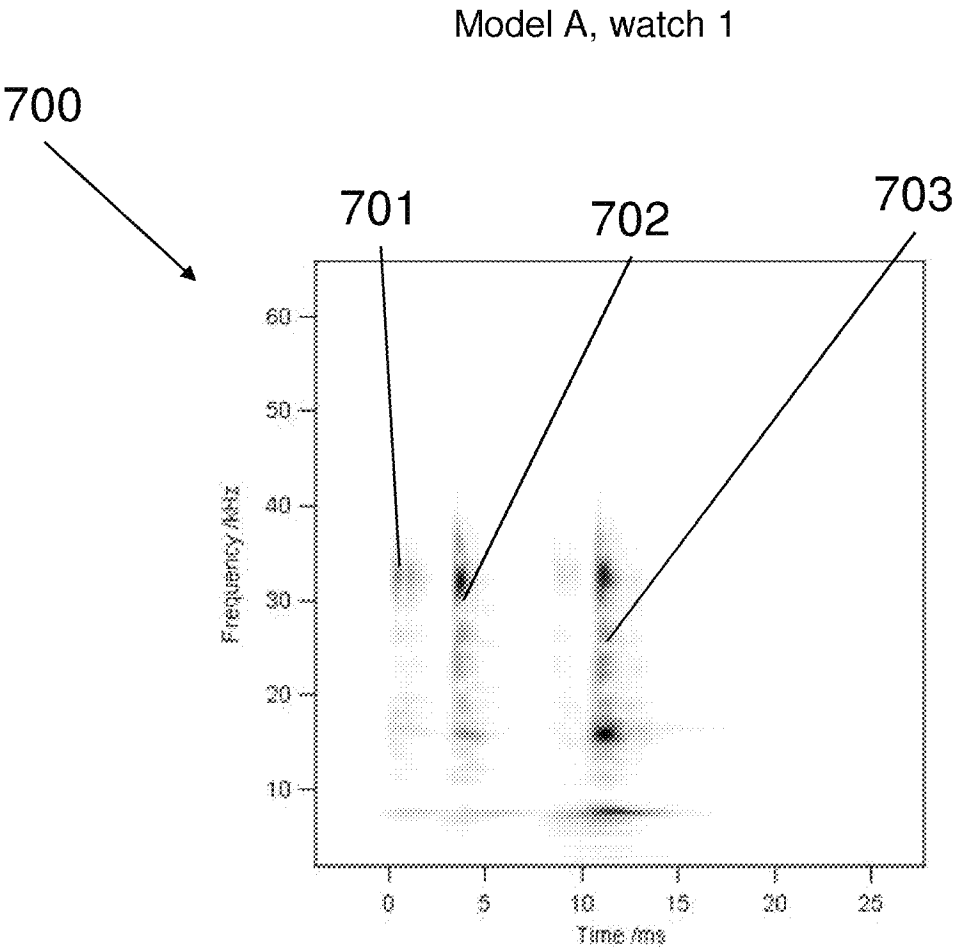
FIG. 7 illustrates a third embodiment of a method for authenticating a timepiece according to the invention.

FIG. 7 illustrates a third embodiment of a method for authenticating a timepiece according to the present invention. FIG. 7 is a time-frequency representation of the acoustic vibrations emitted by the timepiece to be authenticated. FIG. 7 characterizes the electrical signal obtained by measuring acoustic vibrations emitted by the timepiece to be authenticated both in the time domain and frequency domain. Unlike a transform into a frequency domain, which only gives information on the frequencies that are present in the transformed signal, a time-frequency representation gives information on which frequencies are present at which time. A time-frequency representation can therefore be used to associate specific frequencies with specific events taking place in the time domain.

According to the third embodiment of a method for authenticating a timepiece according to the present invention, the time-frequency transform to be used may be one among the several time-frequency transforms available and known to the person skilled in the art. In particular, only to cite a few possible exemplary transforms, the transform into a time-frequency representation may be one of the short-time Fourier transform, a Gabor transform, a Wigner transform, and a wavelet transform.

FIG. 7 shows a time-frequency representation 700 of the measured acoustic vibrations of a timepiece (i.e., model A) to be authenticated, which has been obtained by using a continuous wavelet transform. The wavelet transform is described, for example, in C. Torrence and G. P. Compo, *Bulletin of the American Meteorological Society,* 79, 1998. The use of a wavelet transform represents an exemplary embodiment of the present invention, since the wavelet transform is a convenient tool for time-frequency analysis, with a number of interesting features, such as the possibility to adapt the time-frequency resolution to the problem under investigation, as well as the good mathematical properties. The continuous wavelet transform takes a time-domain signal s(t), the electrical signal of the measured acoustic vibrations emitted by the timepiece to be authenticated, the electrical signal indicating a variation of the magnitude of the measured acoustic vibrations as a function of time, and transforms this time-domain signal into a time-frequency representation W(f, t), which is defined by the following equation (1):

$$W(f,t)=\sqrt{\frac{2\pi f}{c}}\int_{-\infty}^{\infty}s(t')\psi^{*}\left(\frac{2\pi f(t'-t)}{c}\right)dt' \tag{1}$$

where:

ψ is the wavelet function (there are several types to choose from); and c is a constant, which depends on the chosen wavelet function.

The exemplary time-frequency representation shown in FIG. 7, which is also referred to as spectrogram, represents the values of $|W(f,t)|^2$, which has been obtained using a Morlet wavelet (2):

$$\psi_\omega(x) = \pi^{-1/4}\exp(i\omega x - x^2/2) \tag{2}$$

with: $\omega = 40$ and $$c = \frac{\omega + \sqrt{2+\omega^2}}{2} \approx 40.01$$

As mentioned above, according to an embodiment of the invention, the measurements of the acoustic vibrations of the timepiece are carried out on every other acoustic event in the obtained electrical signal. Thus, every other acoustic event in the electrical signal is separated out, i.e., only the "ticks" or the "tocks" of the electrical signal are separated out, and the method for authenticating a timepiece according to an embodiment of the present invention are performed on an electrical signal comprising only every other acoustic event, i.e., only the "ticks" or the "tocks." In the context of the third embodiment, the continuous wavelet transform is applied to this signal of the separated events, and an average is then performed on a predetermined number of acoustic events. According to an exemplary embodiment of the invention, the average is performed over at least 10 acoustic events, preferably at least 20 acoustic events. With the exemplary time-frequency representation 700, an average of twenty acoustic events where used to generate the spectrogram.

As already mentioned above, FIG. 7 is a time-frequency representation of the measured acoustic vibrations of the timepiece to be authenticated, which has been obtained by performing a continuous wavelet transform of the time-domain signal obtained by measuring the acoustic vibrations emitted by the timepiece. In FIG. 7, it can be seen that the spectrogram reveals a first sub-event 701 in a time span comprised between about 0 ms and about 2 ms. A second sub-event 702 is also visible in a time span comprised between about 3 ms and 5 ms. Finally, a third sub-event 703 can be identified in a time span comprised between about 10 ms and 14 ms.

Further to the time information that can be obtained from the spectrogram 700 represented in FIG. 7, frequency information can also be obtained for each of the sub-events identified. Indeed, the frequency values of harmonics leading to peaks in a frequency-domain representation of the electrical signal obtained by measuring the acoustic vibrations of the timepiece to be authenticated can be obtained from the time-frequency representation of FIG. 7 with the additional time information being directly accessible. For instance, as far as the third sub-event 703 is concerned, spots or areas can be identified for the approximate coordinates (11 ms, 32 kHz), (11 ms, 16 kHz). Further, stripes can also be identified, for instance between about 11 and 13 ms, for a frequency of about 8 kHz. As far as the second sub-event 702 is concerned, a spot could also be identified for the approximate coordinate (3.5 ms, 32 kHz).

By using this time-frequency information, which is obtained from a time-frequency representation of the electrical signal obtained by measuring acoustic vibrations emitted by the timepiece to be authenticated, information on an authenticity of the timepiece can be derived. In order to do so, the time-frequency information is extracted from the time-frequency representation and compared with reference time-frequency information, which has been previously stored for the timepiece model. By comparing the time-frequency information extracted for the timepiece to be authenticated with the reference time-information for the timepiece model, the authenticity (or lack thereof) of the timepiece can be derived.

It has been observed by the inventors of the embodiments of the present invention that the reliability and degree of precision of the embodiments of the invention are such that it is possible to even identify differences between the timepieces of an identical model. Indeed, because of manufacturing tolerances, even two timepieces of an identical model differ from each other. When applying the principles underlined in the present invention to different timepieces from the same series and the same manufacturer, it can be seen that the corresponding acoustic measurements are different and the extracted relevant respective pieces of frequency information, which characterize the fingerprint of the respective timepiece, are different. Hence, an identifier (e.g., a unique identifier) can be defined for a timepiece without having to open the timepiece.

Figure 8:
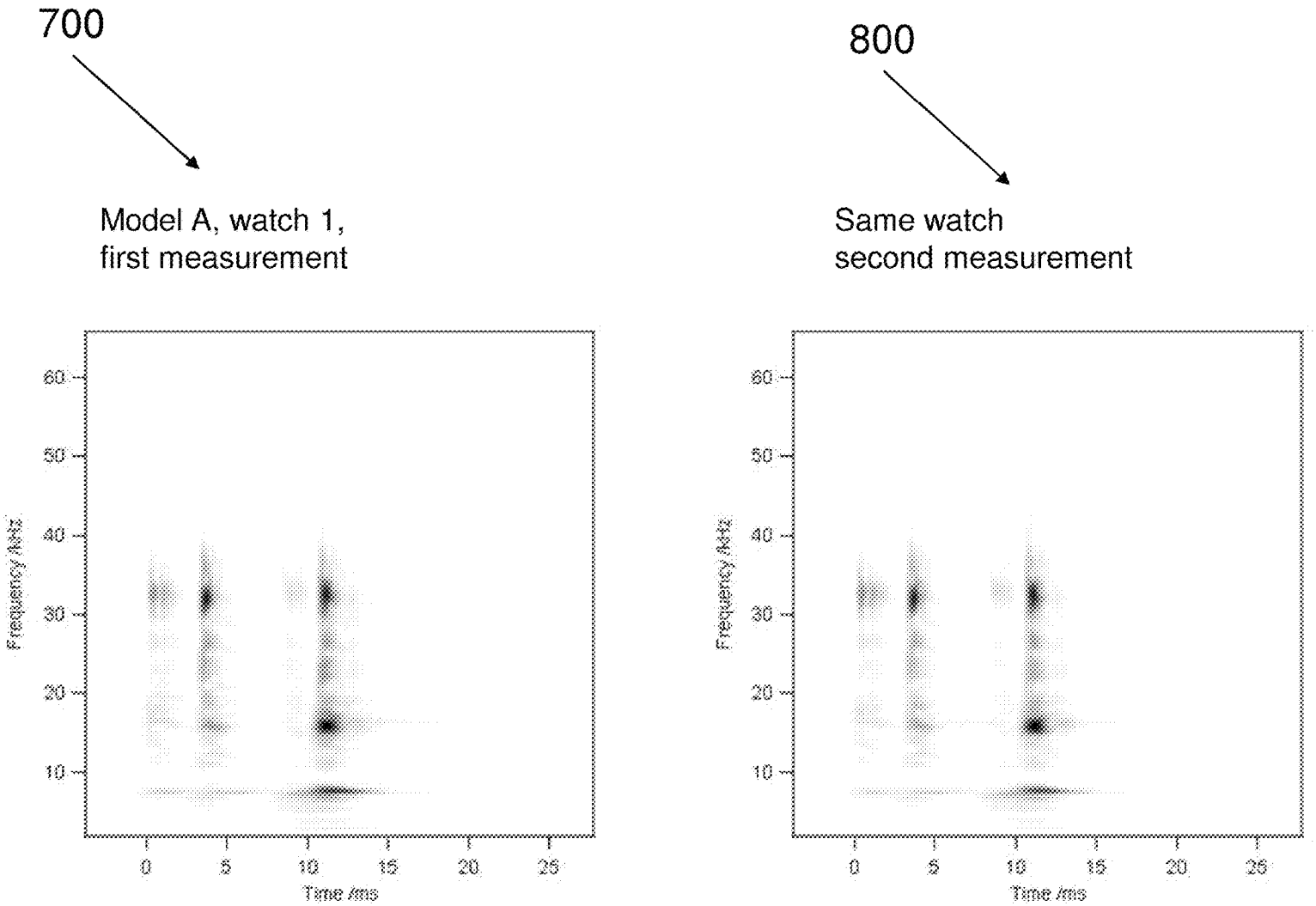
FIG. 8 shows exemplary spectrograms obtained with separate measurements for a first model of a timepiece (i.e., model A) according to aspects of the invention.

FIG. 8 shows exemplary spectrograms 700 and 800 obtained with separate measurements for a first model of a timepiece (i.e., model A) according to aspects of the invention. As shown in FIG. 8, the measurements for a particular model are repeatable and consistent. That is, spectrogram 700 is approximately the same as spectrogram 800. As such, in accordance with aspects of the present invention, the measurements remain consistent, and thus, may be used to identify a timepiece.

Figure 9:
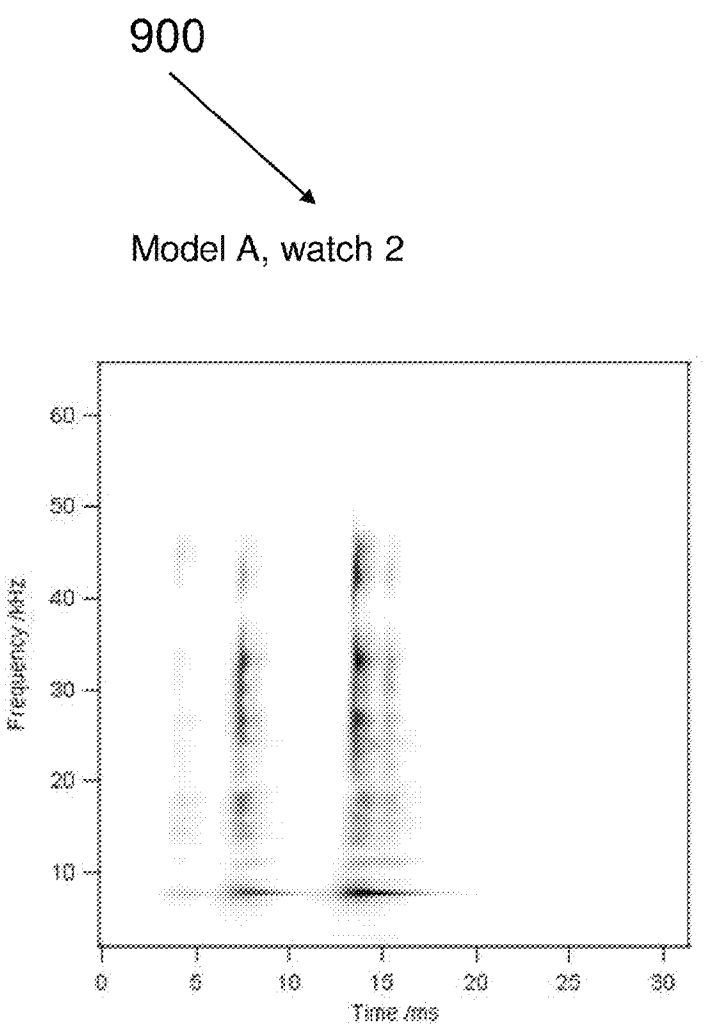
FIG. 9 shows exemplary spectrograms for two different timepieces that are the same model in accordance with aspects of the invention.
Figure 9:
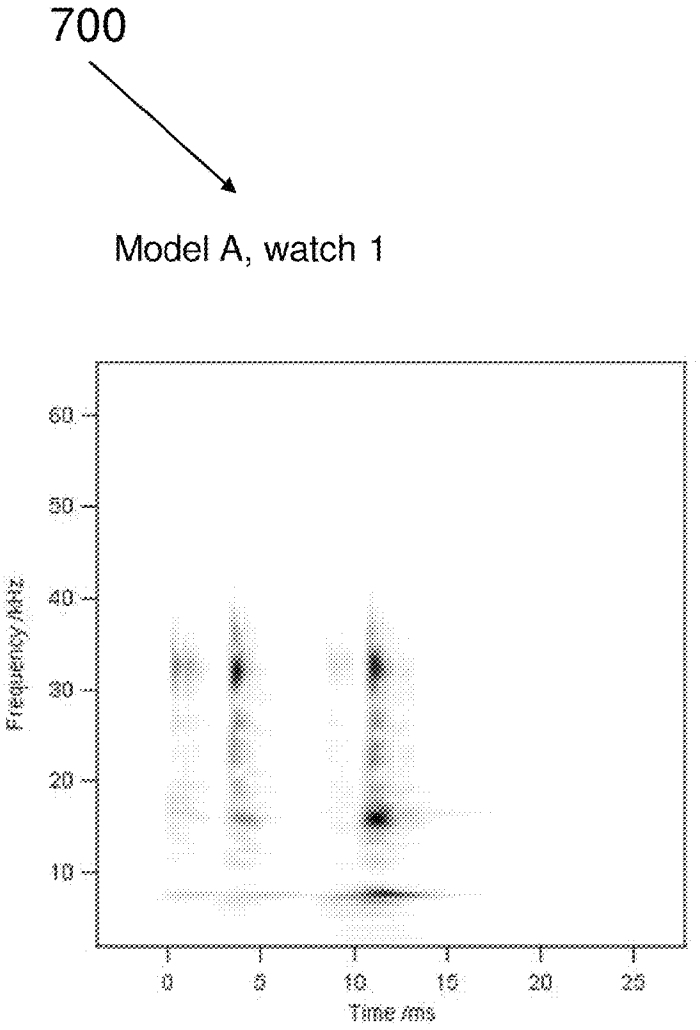

FIG. 9 shows exemplary spectrograms 700 and 900 for two different timepieces (i.e., watch 1 and watch 2) that are the same model (i.e., model A), in accordance with aspects of the invention. As shown in FIG. 9, spectrogram 900 differs significantly from spectrogram 700, which indicates that even timepieces of the same model may have different acoustic signatures, such that the acoustic signature may serve as a unique identifier, in accordance with aspects of the present invention.

Figure 10:
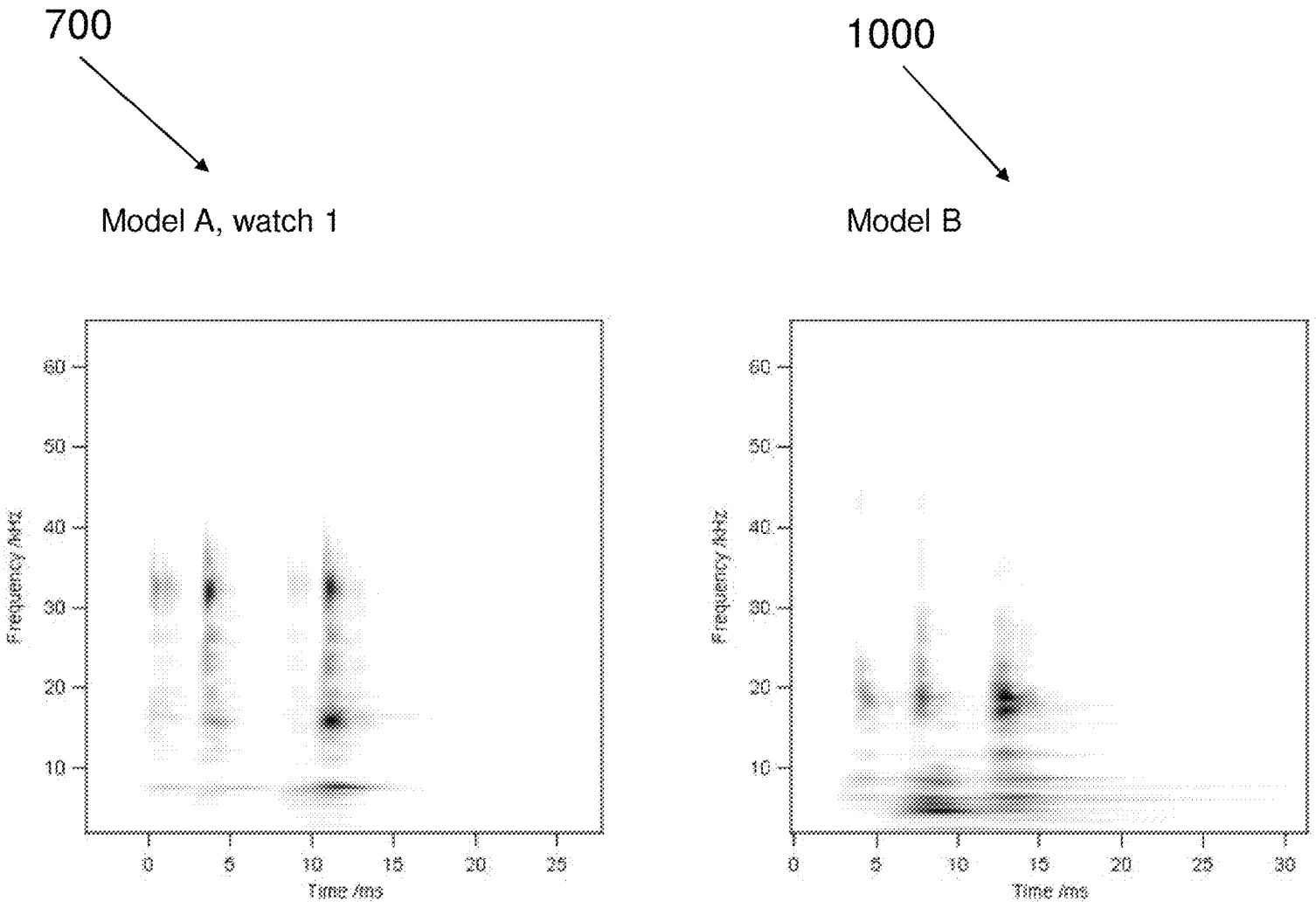
FIG. 10 shows exemplary spectrograms for two different models of timepieces in accordance with aspects of the invention.
Figure 11:
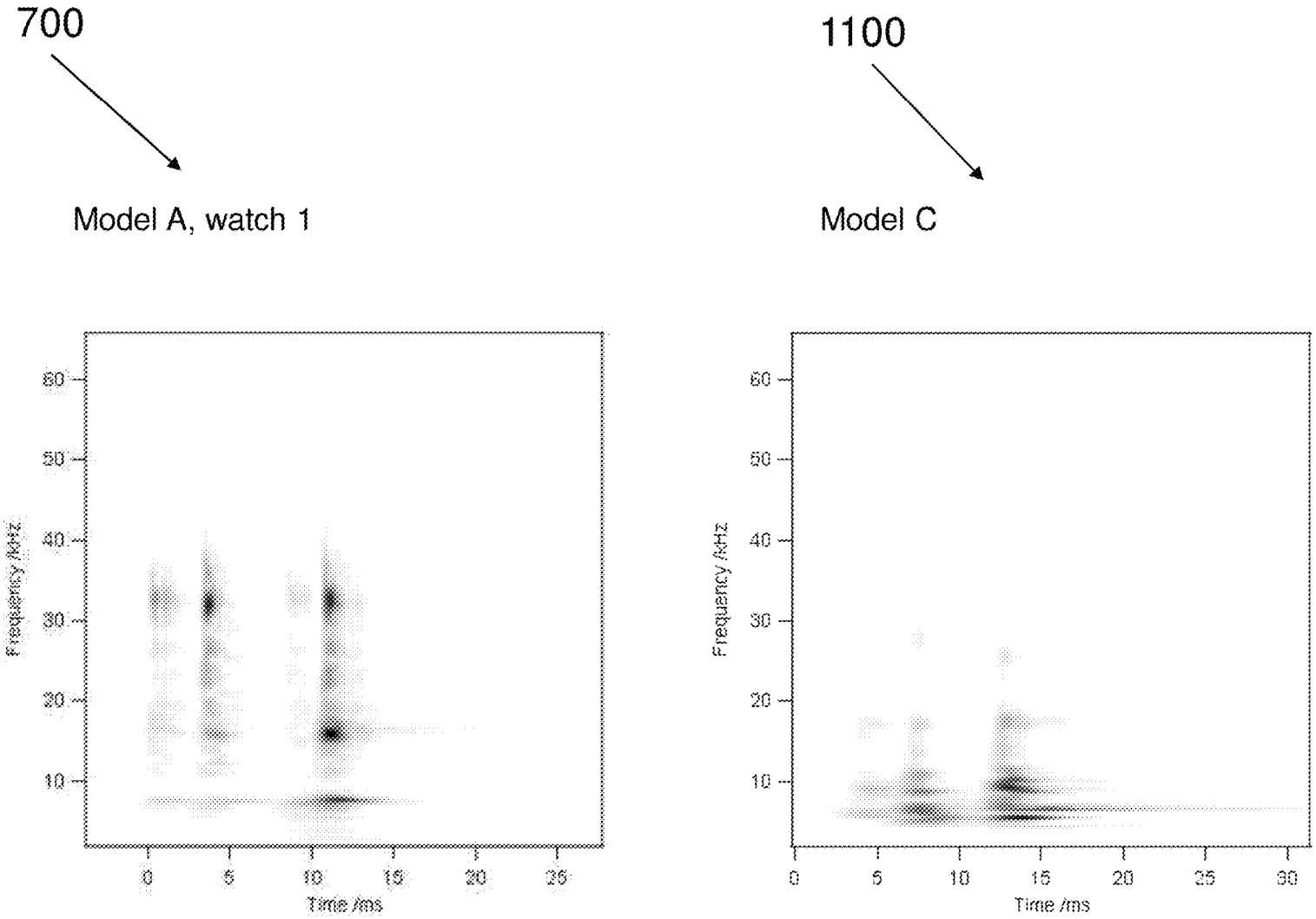
FIG. 11 shows exemplary spectrograms for two different models of timepieces in accordance with aspects of the invention.

FIG. 10 shows exemplary spectrograms 700 and 1000 for two different models of timepieces (i.e., model A and model B), in accordance with aspects of the invention. FIG. 11 shows exemplary spectrograms 700 and 1100 for two different models of timepieces (i.e., model A and model C), in accordance with aspects of the invention. As shown in FIGS. 10 and 11, different models of timepieces will have different characteristic time-frequency representations. In accordance with aspects of embodiments of the present invention, spectrograms 700, 1000, and 1100 show that each timepiece model (e.g., model A, model B, and model C) can be associated with a characteristic time-frequency representation. Consequently, by comparing the time-frequency representation of a timepiece to be authenticated with a reference time-frequency representation, which is expected for this particular timepiece model, authenticity information on the timepiece to be authenticated can be derived. Hence, it can be derived whether a timepiece to be authenticated is an authentic product or a counterfeit product. Additionally, as shown in FIG. 9, the same model of watch may exhibit different time-frequency representations, such that the time-frequency representation may be used as a unique identifier for a particular timepiece.

The above-described measurements of a particular timepiece should not change over time (i.e., remain stable). For example, as long as components of the watch are not touched or manipulated, the above-described measurements of a particular timepiece will not change. Of course, with maintenance of the timepiece (e.g., when the timepiece is opened), the above-described measurements may be affected. As such, when timepiece maintenance is performed (e.g., when the timepiece is opened), the timepiece should be recertified (e.g., the sound of the timepiece should be recaptured, and the results of the one or more the above-described measurements should be identified and stored). In embodiments, once the timepiece is recertified, the results of the one or more the above-described measurements may also be linked with the timepiece ID (e.g., the timepiece serial number), for example, in a database.

While the above-described measurements a timepiece should not change over time, the embodiments of the invention contemplate that some of the above-described measurements of respective timepiece may change (e.g., slightly) over time. By way of a non-limiting example, the escapement wheel may change in mass with wear as the timepiece ages. Thus, in accordance with embodiments of the invention, a threshold for determining a positive authentication of a timepiece may be configured (e.g., lowered) in dependence upon an age of the timepiece. That is, in embodiments, an older timepiece may be subjected to a lower threshold for a positive authentication via comparison with stored time measurements, frequency measurements, and/or magnitude measurements (or stored identifiers based upon the measurements). In embodiments, the timepiece may be recertified on a regular basis (e.g., yearly) to account for the evolution (e.g., any property changes) of the timepiece over time.

With wind-up watches, the state of winding may impact how fast a watch is running, and the strength of the impacts within a watch. However, in a similar manner to a piano, whose respective strings will produce the same note regardless of the strength of impact, the state of winding should not impact the frequency of the emitted sound. Additionally, while the state of winding may impact how fast a watch is running, in accordance with embodiments of the present invention, a relative time delay may be used to account for the running speed of the watch.

With additional embodiments of the present invention, by detecting the emitted sounds of a timepiece, for example, a number of teeth on an escapement wheel and/or a number of beats per second may be determined. For example, a determination of the number of teeth of the escapement wheel may be used to positively identify a specific model of a timepiece. This information may additionally serve to identify counterfeit timepieces, as, for example, a counterfeit timepiece may produce a different number of beats per second.

Figure 12:
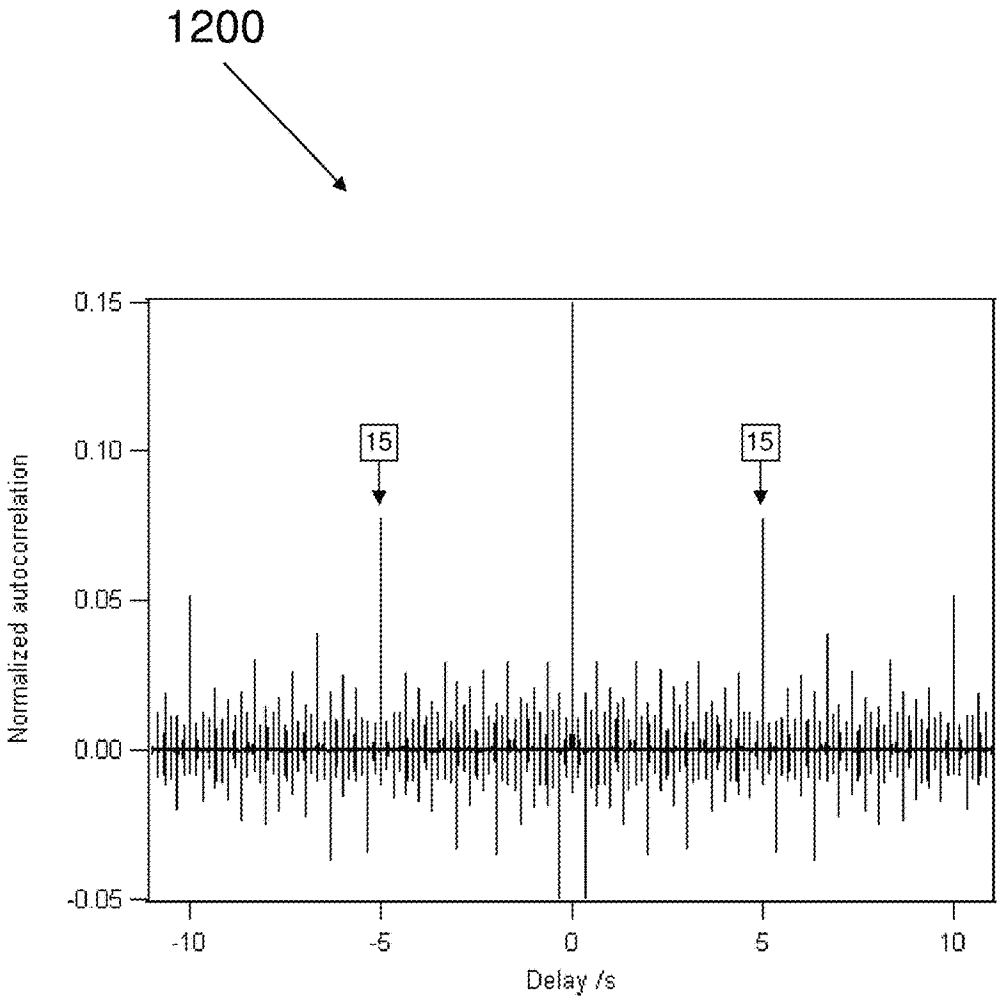
FIG. 12 illustrates a graph of normalized autocorrelation versus delay that may be utilized to determine information about the escapement wheel in accordance with aspects of embodiments of the present invention.

FIG. 12 illustrates a graph 1200 of normalized autocorrelation versus delay that may be utilized to determine information about the escapement wheel in accordance with aspects of embodiments of the present invention. With this exemplary embodiment, autocorrelation is used to gain information about the escapement wheel. Autocorrelation $R_{ff}(\tau)$ of a function $f(t)$ is defined as equation (3):

$$R_{ff}(\tau)=\int f(t+\tau)f(t)dt \tag{3}$$

FIG. 12 shows the autocorrelation function $R_{gg}$ of $$g(t)=\text{abs}(s(t))-\text{abs}(s(t+\Delta t)),$$

where $\Delta t$ is the period of the balance oscillation, which is equal to the inverse of the oscillation rate.

As shown in FIG. 12, in this example the oscillation rate is 3 Hz, and $\Delta t=1/3$ s. The escapement wheel has 15 teeth, which results in a prominent peak at $\tau=5$ s, corresponding to a full revolution of the escapement wheel (15 oscillations).

Although similar information can also be found in the autocorrelation of abs(s(t)), or even of the raw signal s(t), and the invention contemplates such an approach, it is particularly advantageous to use the autocorrelation of g(t) as defined above. That is, g(t) is the difference between the absolute value of the signal and the absolute value of the signal delayed by one period. This approach emphasizes the event-to-event amplitude variations and their periodic dependence on the escapement wheel position.

In further contemplated embodiments, it is possible to use $$g(t)=\text{abs}(s(t))-\langle \text{abs}(s(t))\rangle_N$$

Where $\langle \text{abs}(s(t))\rangle_N$ is the average of abs(s(t)) over N events, or:

$$\langle \text{abs}(s(t))\rangle_N = \frac{1}{N}\sum_{p=0}^{N} \text{abs}(s(t+p\Delta t)).$$

Figure 13:
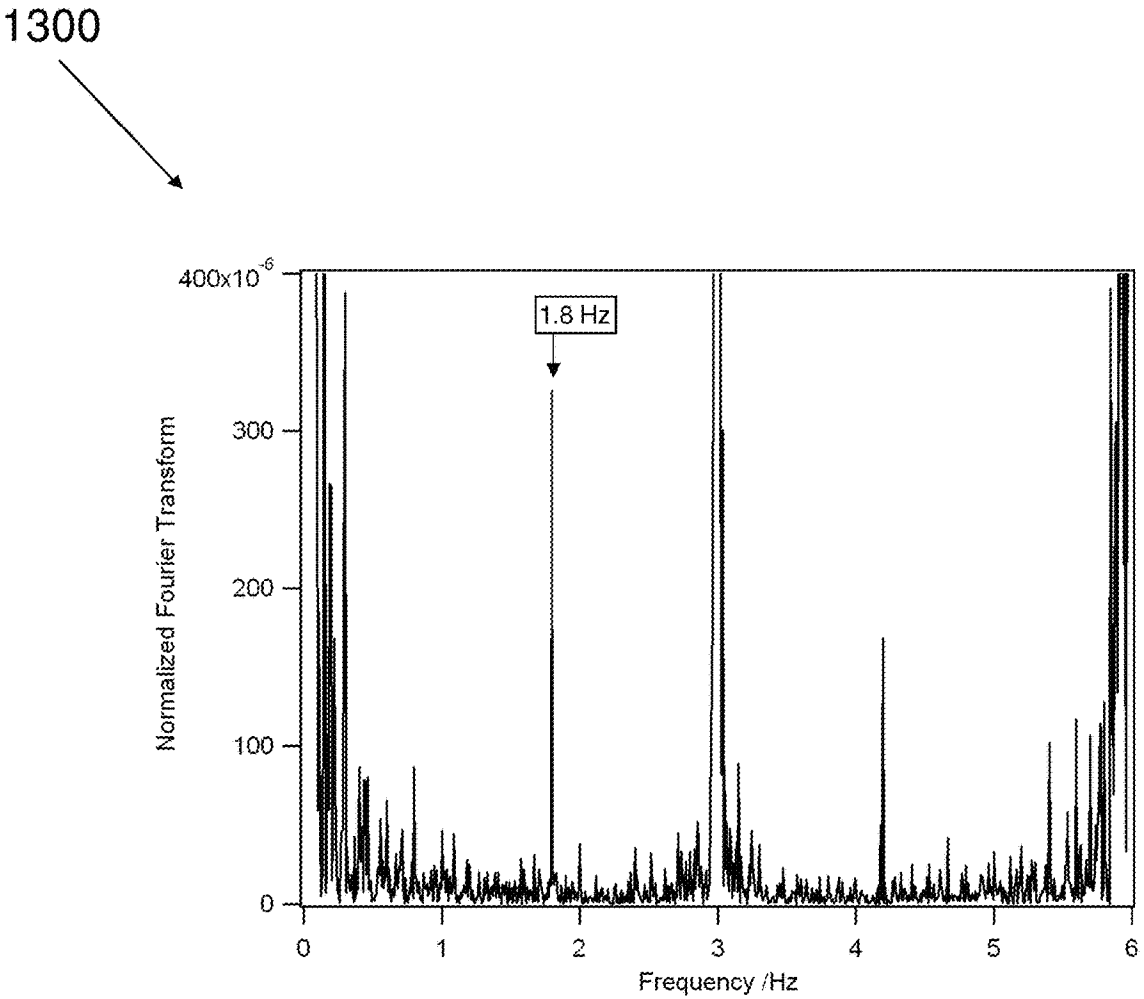
FIG. 13 illustrates the square modulus of the Fast Fourier Transform of abs(s(t)) in accordance with aspects of embodiments of the present invention.

In further contemplated embodiments of the present invention, a Fourier transform may be used to obtain information about the number of teeth of the escapement wheel pinion. FIG. 13 illustrates the square modulus of the Fast Fourier Transform of abs(s(t)) 1300 in accordance with aspects of embodiments of the present invention. As shown in FIG. 13, next to the main peaks at 6 and 3 Hz, corresponding, respectively, to the beat and the oscillation frequency of the escapement, another peak is visible at 1.8 Hz. This peak results from the escapement wheel having 9 teeth, hence abs(s(t)) is modulated by the repeated engagement and disengagement of the pinion teeth on the next wheel of the gear train, which happens at a rate given by the following equation (4):

$$\text{rate}=\text{oscillation rate}\times\text{number of teeth on the pinion}/\text{number of teeth of the escapement wheel} \tag{4}$$

With the present example of FIG. 13, the rate is 3 Hz*9/15=1.8 Hz

The invention contemplates other possibilities for identifying characteristics of a timepiece, whereby the signal is pre-processed before the Fourier transform. For example, pre-processing may involve integrating the signal to give the sequence:

$$S(t_i) = \int_{t_i}^{t_i+t_2} \text{abs}(s(t_i))dt$$

$$t_i = t_1 + i\Delta t$$

where $\Delta t$ is the period of the balance oscillation, and $t_1$, $t_2$ are the starting time and the integration interval.

Figure 14:
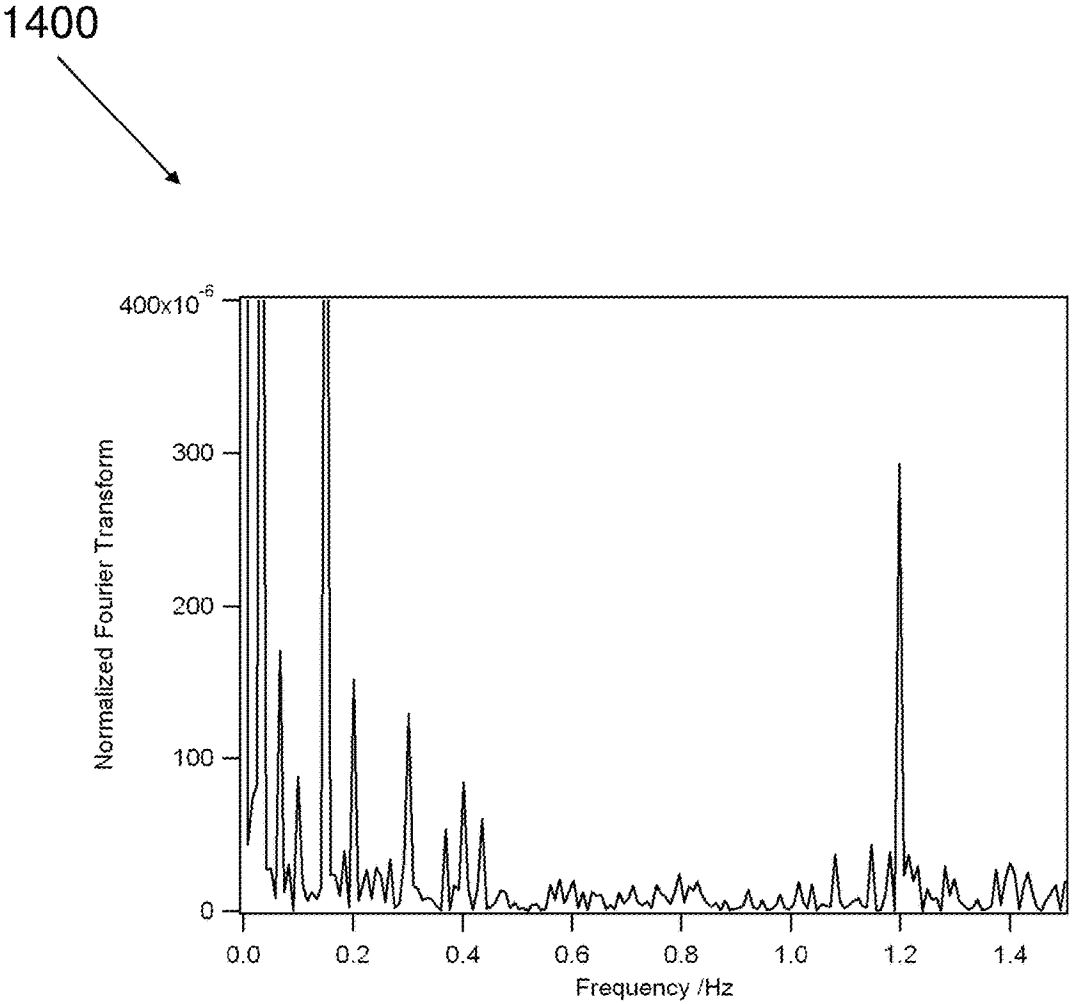
FIG. 14 shows a Fourier Transform of $S(t_i)$ also having a peak, which reflects the number of teeth in the escapement wheel pinion in accordance with aspects of embodiments of the present invention.

FIG. 14 shows a Fourier Transform of $S(t_i)$ also having a peak, which reflects the number of teeth in the escapement wheel pinion in accordance with aspects of embodiments of the present invention. It should be noted that in this exemplary case, because the sequence is sampled at 3 Hz, the 1.8 Hz frequency (as discussed above with reference to FIG. 13) is aliased at 1.2 Hz, as predicted by Nyquist-Shannon sampling theorem.

With further contemplated embodiments, the analysis of a timepiece may be in two levels (e.g., a less intense first level and a more intense second level. For example, with a first level of analysis (e.g., an initial assessment), the timepiece may be identified by a make and model (e.g., using the number of teeth of the escapement wheel), to determine if the timepiece is authentic (i.e., verified as a particular make and model). With this first level of analysis, an assessment may determine, for example, that the timepiece includes the correct components. A second level of analysis may include a deeper analysis of the emitted sounds, to identify a unique "finger print" for the timepiece. This unique "finger print" may be stored in a database and/or compared with previously stored finger prints to positively identify the timepiece. In embodiments, either or both of the first and second levels of analysis may be done with a new timepiece, or with used timepieces that have not been previously analyzed.

System Environment

As will be appreciated by one skilled in the art, the present invention may be embodied as a timepiece, a system, a method or a computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following:

- an electrical connection having one or more wires,
- a portable computer diskette,
- a hard disk,
- a random access memory (RAM),
- a read-only memory (ROM),
- an erasable programmable read-only memory (EPROM or Flash memory),
- an optical fiber,
- a portable compact disc read-only memory (CDROM),
- an optical storage device,
- a transmission media such as those supporting the Internet or an intranet,
- a magnetic storage device
- a usb key,
- a certificate,
- a perforated card, and/or
- a mobile phone.

In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network. This may include, for example, a local area network (LAN) or a wide area network (WAN), or the connection may be made to an external computer (for example, through the Internet using an Internet Service Provider). Additionally, in embodiments, the present invention may be embodied in a field programmable gate array (FPGA).

Figure 15:
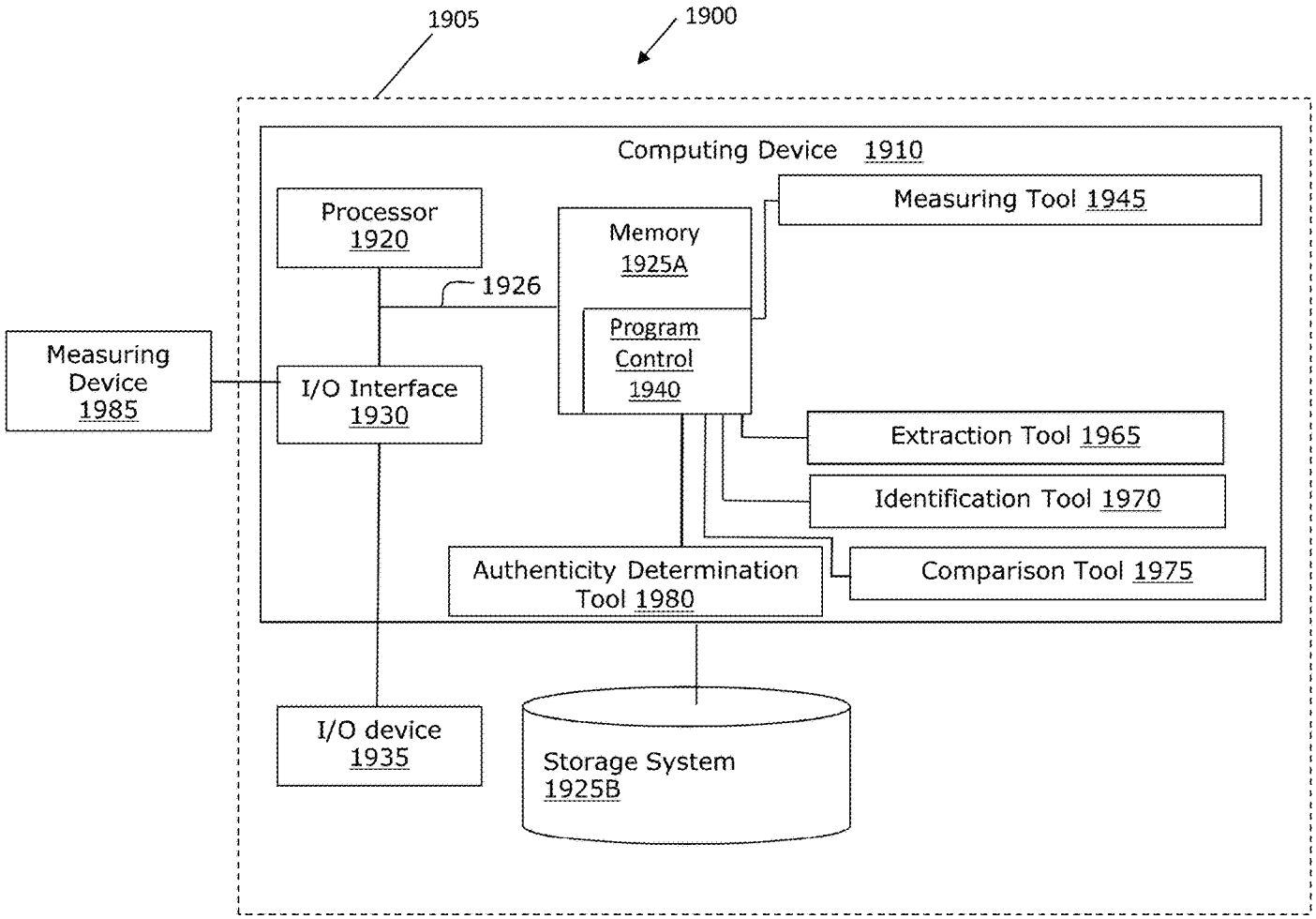
FIG. 15 shows an illustrative environment for managing the processes in accordance with embodiments of the invention.

FIG. 15 shows an illustrative environment 1900 for managing the processes in accordance with the invention. To this extent, the environment 1900 includes a server or other computing system 1905 that can perform the processes described herein. In particular, the server 1905 includes a computing device 1910. The computing device 1910 can be resident on a network infrastructure or computing device of a third party service provider (any of which is generally represented in FIG. 15).

In embodiments, the computing device 1910 includes a measuring tool 1945, an extraction tool 1965, an identification tool 1970, a comparison tool 1975, and an authenticity determination tool 1980, which are operable to measure one or more detected sounds or vibrations, extract from an electrical signal or from a representation of said electrical signal in a time, frequency or time-frequency domain at least one of: magnitude information on a magnitude of one of said plurality of acoustic events, time information on said one of said plurality of acoustic events, and frequency information on a frequency of said one of said plurality of acoustic events, create an identifier based on the extracted information, compare the extracted information with stored information, and determine an authenticity, e.g., the processes described herein. The measuring tool 1945, the extraction tool 1965, the identification tool 1970, the comparison tool 1975, and the authenticity determination tool 1980 can be implemented as one or more program code in the program control 1940 stored in memory 1925A as separate or combined modules.

The computing device 1910 also includes a processor 1920, memory 1925A, an I/O interface 1930, and a bus 1926. The memory 1925A can include local memory employed during actual execution of program code, bulk storage, and cache memories which provide temporary storage of at least some program code in order to reduce the number of times code must be retrieved from bulk storage during execution. In addition, the computing device includes random access memory (RAM), a read-only memory (ROM), and an operating system (O/S).

The computing device 1910 is in communication with the external I/O device/resource 1935 and the storage system 1925B. For example, the I/O device 1935 can comprise any device that enables an individual to interact with the computing device 1910 or any device that enables the computing device 1910 to communicate with one or more other computing devices using any type of communications link. The external I/O device/resource 1935 may be for example, a handheld device, PDA, handset, keyboard, smartphone, etc. Additionally, in accordance with aspects of the invention, the environment 1900 includes a measuring device 1985 for measuring sound vibrations (e.g., sonic emissions) from one or more timepieces.

In general, the processor 1920 executes computer program code (e.g., program control 1940), which can be stored in the memory 1925A and/or storage system 1925B. Moreover, in accordance with aspects of the invention, the program control 1940 having program code controls the measuring tool 1945, the extraction tool 1965, the identification tool 1970, the comparison tool 1975, and the authenticity determination tool 1980. While executing the computer program code, the processor 1920 can read and/or write data to/from memory 1925A, storage system 1925B, and/or I/O interface 1930. The program code executes the processes of the invention. The bus 1926 provides a communications link between each of the components in the computing device 1910.

The computing device 1910 can comprise any general purpose computing article of manufacture capable of executing computer program code installed thereon (e.g., a personal computer, server, etc.). However, it is understood that the computing device 1910 is only representative of various possible equivalent-computing devices that may perform the processes described herein. To this extent, in embodiments, the functionality provided by the computing device 1910 can be implemented by a computing article of manufacture that includes any combination of general and/or specific purpose hardware and/or computer program code. In each embodiment, the program code and hardware can be created using standard programming and engineering techniques, respectively.

Similarly, the computing infrastructure 1905 is only illustrative of various types of computer infrastructures for implementing the invention. For example, in embodiments, the server 1905 comprises two or more computing devices (e.g., a server cluster) that communicate over any type of communications link, such as a network, a shared memory, or the like, to perform the process described herein. Further, while performing the processes described herein, one or more computing devices on the server 1905 can communicate with one or more other computing devices external to the server 1905 using any type of communications link. The communications link can comprise any combination of wired and/or wireless links; any combination of one or more types of networks (e.g., the Internet, a wide area network, a local area network, a virtual private network, etc.); and/or utilize any combination of transmission techniques and protocols.

Flow Diagrams

Figure 16:
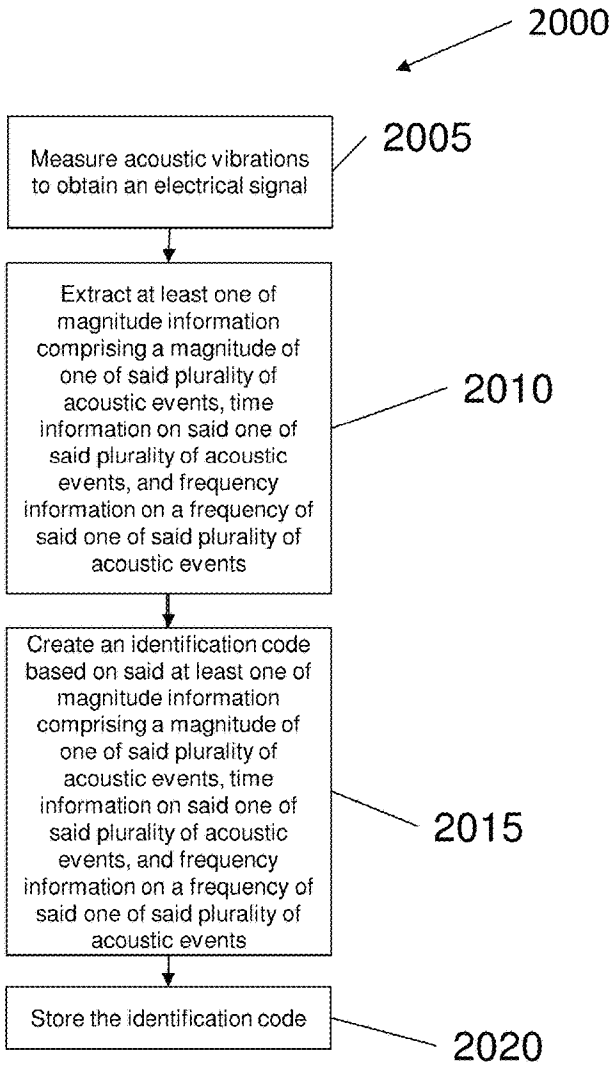
FIGS. 16 and 17 show exemplary flows for performing aspects of embodiments of the present invention.
Figure 17:
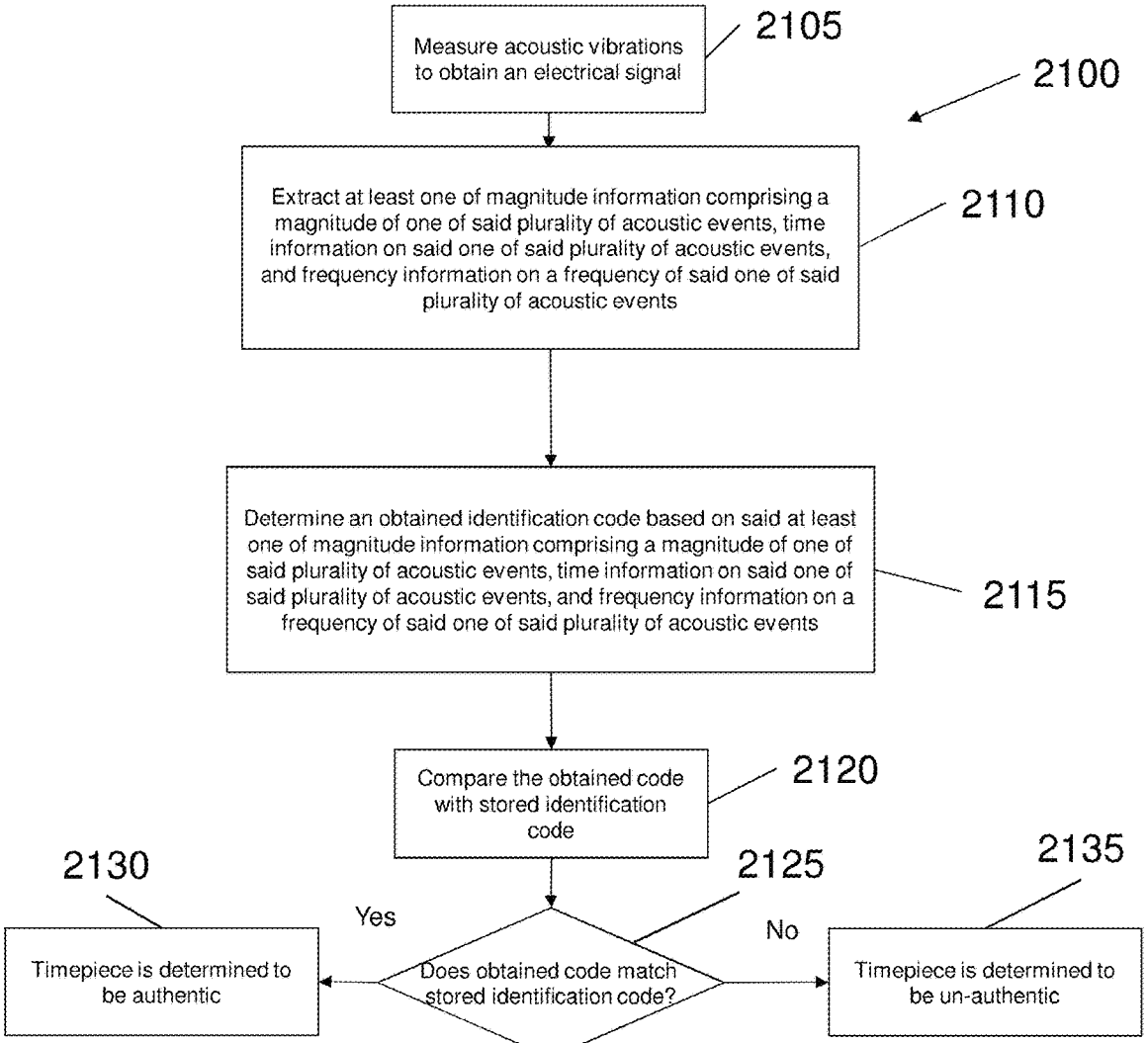

FIGS. 16 and 17 show exemplary flows for performing aspects of the present invention. The steps of FIGS. 16 and 17 may be implemented in the environment of FIG. 15, for example. The flow diagrams may equally represent high-level block diagrams of embodiments of the invention. The flowcharts and/or block diagrams in FIGS. 16 and 17 illustrate the architecture, functionality, and operation of possible implementations of systems, methods and computer program products according to various embodiments of the present invention. In this regard, each block in the flowcharts or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of each flowchart, and combinations of the flowchart illustrations can be implemented by special purpose hardware-based systems that perform the specified functions or acts, or combinations of special purpose hardware and computer instructions and/or software, as described above. Moreover, the steps of the flow diagrams may be implemented and executed from either a server, in a client server relationship, or they may run on a user workstation with operative information conveyed to the user workstation. In an embodiment, the software elements include firmware, resident software, microcode, etc.

Furthermore, the invention can take the form of a computer program product accessible from a computer-usable or computer-readable medium providing program code for use by or in connection with a computer or any instruction execution system. The software and/or computer program product can be implemented in the environment of FIG. 15. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disc-read/write (CD-R/W) and DVD.

FIG. 16 illustrates an exemplary flow 2000 for creating and storing an identification code for a timepiece. At step 2005, the measuring tool measures acoustic vibrations to obtain an electrical signal. As shown in FIG. 16, at step 2010, the extraction tool extracts from said electrical signal or from a representation of said electrical signal in a time, frequency or time-frequency domain at least one of: magnitude information on a magnitude of one of said plurality of acoustic events, time information on said one of said plurality of acoustic events, and frequency information on a frequency of said one of said plurality of acoustic events. At step 2015, the identification tool creates an identification code based on at least one of the magnitude information, the time information, and the frequency information. At step 2020, the identification tool stores the identification code in a storage system, e.g., a database.

FIG. 17 illustrates an exemplary flow 2100 for authentication and/or identification of a timepiece. As shown in FIG. 17, at step 2105, the measuring tool measures acoustic vibrations to obtain an electrical signal. At step 2110, the extraction tool extracts from said electrical signal or from a representation of said electrical signal in a time, frequency or time-frequency domain at least one of: magnitude information on a magnitude of one of said plurality of acoustic events, time information on said one of said plurality of acoustic events, and frequency information on a frequency of said one of said plurality of acoustic events. At step 2115, the identification tool creates an obtained identification code based at least one of the magnitude information, the time information, and the frequency information. At step 2120, the comparison tool compares the obtained code with stored identification codes. At step 2125, the authentication determination tool determines whether the obtained code matches a stored identification code. If, at step 2125, the authentication determination tool determines that the obtained code matches a stored identification code, at step 2130, the timepiece is determined to be authentic. If, at step 2125, the authentication determination tool determines that the obtained code match does not match a stored identification code, at step 2135, the timepiece is determined to be un-authentic.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

What is claimed is:

1. A method for authenticating a timepiece comprising executing on a processor of a computing device a computer program code, the computing device further comprising a memory storing a program control configured to control a measuring module, an extraction module, an identification module, a comparison module and an authenticity determination module that are implemented as separate or combined modules in the computing device, to perform the steps of:

measuring by the measuring module acoustic vibrations emitted by an escapement of a mechanical movement of said timepiece using a microphone to obtain an electrical signal, said electrical signal indicating a variation of a magnitude of said measured acoustic vibrations as a function of time, wherein said electrical signal comprises a plurality of ticking acoustic events associated with mechanical shocks taking place in said timepiece, wherein the mechanical shocks are caused by a gear train of the mechanical movement stopping at escapement locks of the escapement;

separating every other ticking acoustic event in said electrical signal;

extracting by the extraction module from said electrical signal or from a representation of said electrical signal in a time, frequency or time-frequency domain at least one of: magnitude information on a magnitude of one of said plurality of ticking acoustic events, time information on said one of said plurality of ticking acoustic events, and frequency information on a frequency of said one of said plurality of ticking acoustic events;

comparing by the comparison module said extracted at least one of magnitude information, time information and frequency information with at least one of reference magnitude information, reference time information and reference frequency information; and providing by the authenticity determination module an indication of authenticity comprising issuing a signal indicating authenticity when the comparing indicates a match between the extracted information and reference information, and providing an indication of non-authenticity comprising issuing a signal indicating non-authenticity when the comparing indicates no match between the extracted information and reference information, wherein said extracting comprises extracting, in a time sequence of said electrical signal corresponding to one of said plurality of ticking acoustic events, at least one of:

amplitude information on an amplitude of a first acoustic sub-event of said one of said plurality of ticking acoustic events, and time delay information on a time delay between a first acoustic sub-event of said one of said plurality of ticking acoustic events and a second acoustic sub-event of said one of said plurality of ticking acoustic events, wherein the method is performed on the electrical signal comprising only every other ticking acoustic event.

2. The method according to claim 1, further comprising performing a transform of said electrical signal into a frequency domain to obtain a frequency-domain power spectrum indicating a variation of a power of said electrical signal as a function of frequency, wherein said extracting comprises extracting at least one frequency information on a frequency associated with a peak of said frequency-domain power spectrum.

3. The method according to claim 2, wherein said transform of said electrical signal into the frequency domain is a Fourier transform.

4. The method according to claim 3, wherein the Fourier transform is a Fast Fourier transform.

5. The method according to claim 1, further comprising performing a transform of said electrical signal into a time-frequency representation indicating frequency information of said electrical signal as a function of time, wherein said extracting comprises extracting at least one of the frequency information and the time information in said time-frequency representation of said electrical signal.

6. The method according to claim 5, wherein said transform of said electrical signal into the time-frequency representation is one of a short-time Fourier transform, a Gabor transform, a Wigner transform, and a wavelet transform.

7. The method of claim 1, wherein the signal comprises at least one of: an alert, a hold signal, an alarm, and a notification.

8. A non-transitory computer readable medium for storing computer program code executable by a processor of a computing device, the computing device further comprising a memory storing a program control configured to control a measuring module, an extraction module, an identification module, a comparison module and an authenticity determination module that are implemented as separate or combined modules in the computing device, to cause the processor to perform a method comprising:

measuring by the measuring module acoustic vibrations emitted by an escapement of a mechanical movement of a timepiece using a microphone to obtain an electrical signal, said electrical signal indicating a variation of a magnitude of said measured acoustic vibrations as a function of time, wherein said electrical signal comprises a plurality of ticking acoustic events associated with mechanical shocks taking place in said timepiece, wherein the mechanical shocks are caused by a gear train of the mechanical movement stopping at escapement locks of the escapement;

separating every other ticking acoustic event in said electrical signal;

extracting by the extraction module from said electrical signal or from a representation of said electrical signal in a time, frequency or time-frequency domain at least one of magnitude information comprising a magnitude of one of said plurality of ticking acoustic events, time information on said one of said plurality of ticking acoustic events, and frequency information on a frequency of said one of said plurality of ticking acoustic events;

comparing by the comparison module said extracted at least one of a magnitude information, time information and frequency information with at least one of a reference magnitude information, reference time information and reference frequency information; and providing by the authenticity determination module an indication of authenticity comprising issuing a signal indicating authenticity when the comparing indicates a match between the extracted information and reference information, and providing an indication of non-authenticity comprising issuing a signal indicating non-authenticity when the comparing indicates no match between the extracted information and reference information, wherein said extracting comprises extracting, in a time sequence of said electrical signal corresponding to one of said plurality of ticking acoustic events, at least one of:

amplitude information on an amplitude of a first acoustic sub-event of said one of said plurality of ticking acoustic events, and time delay information on a time delay between a first acoustic sub-event of said one of said plurality of ticking acoustic events and a second acoustic sub-event of said one of said plurality of ticking acoustic events, wherein the method is performed on the electrical signal comprising only every other ticking acoustic event.

9. A system for authenticating a timepiece comprising a computing device comprising a processor and a memory storing a program control configured to control a measuring module, an extraction module, an identification module, a comparison module and an authenticity determination module that are implemented as separate or combined modules in the computing device, wherein the processor is configured to execute computer program code to perform a method comprising:

measuring by the measuring module acoustic vibrations emitted by an escapement of a mechanical movement of said timepiece using a microphone to obtain an electrical signal, said electrical signal indicating a variation of a magnitude of said measured acoustic vibrations as a function of time, wherein said electrical signal comprises a plurality of ticking acoustic events associated with mechanical shocks taking place in said timepiece, wherein the mechanical shocks are caused by a gear train of the mechanical movement stopping at escapement locks of the escapement;

separating every other ticking acoustic event in said electrical signal;

extracting by the extraction module from said electrical signal or from a representation of said electrical signal in a time, frequency or time-frequency domain at least one of: magnitude information on a magnitude of one of said plurality of ticking acoustic events, time information on said one of said plurality of ticking acoustic events, and frequency information on a frequency of said one of said plurality of ticking acoustic events;

creating by the identification module an identification code based on said at least one of the magnitude information, the time information and the frequency information;

comparing by the comparison module said identification code with at least one stored identification code; and providing by the authenticity determination module an indication of authenticity comprising issuing a signal indicating authenticity when the comparison tool indicates a match between the extracted information and reference information, and providing an indication of non-authenticity comprising issuing a signal indicating non-authenticity when the comparing indicates no match between the extracted information and reference information, wherein said extracting comprises extracting, in a time sequence of said electrical signal corresponding to one of said plurality of ticking acoustic events, at least one of:

amplitude information on an amplitude of a first acoustic sub-event of said one of said plurality of ticking acoustic events, and time delay information on a time delay between a first acoustic sub-event of said one of said plurality of ticking acoustic events and a second acoustic sub-event of said one of said plurality of ticking acoustic events, wherein the method is performed on the electrical signal comprising only every other ticking acoustic event.

10. A method for generating an identifier for a timepiece, the method comprising executing on a processor of a computing device a computer program code, the computing device further comprising a memory storing a program control configured to control a measuring module, an extraction module, an identification module, a comparison module and an authenticity determination module that are implemented as separate or combined modules in the computing device, to perform the steps of:

measuring by the measuring module acoustic vibrations emitted by an escapement of a mechanical movement of said timepiece using a microphone to obtain an electrical signal, said electrical signal indicating a variation of a magnitude of said measured acoustic vibrations as a function of time, wherein said electrical signal comprises a plurality of ticking acoustic events associated with mechanical shocks taking place in said timepiece, wherein the mechanical shocks are caused by a gear train of the mechanical movement stopping at escapement locks of the escapement;

separating every other ticking acoustic event in said electrical signal;

extracting by the extraction module from said electrical signal or from a representation of said electrical signal in a time, frequency or time-frequency domain at least one of: magnitude information on a magnitude of one of said plurality of ticking acoustic events, time information on said one of said plurality of ticking acoustic events, and frequency information on a frequency of said one of said plurality of ticking acoustic events;

creating by the identification module the identifier comprising an identification code based on said at least one of the magnitude information, the time information and the frequency information, wherein the identification code is utilizable to identify the timepiece as being authentic through:

a comparison by the comparison module of the identification code with at least one stored identification code; and providing by the authenticity determination module an indication of authenticity comprising issuing a signal indicating authenticity when the identification code indicates authenticity, and providing an indication of non-authenticity comprising issuing a signal indicating non-authenticity when the identification code indicates non-authenticity, wherein said extracting comprises extracting, in a time sequence of said electrical signal corresponding to one of said plurality of ticking acoustic events, at least one of:

amplitude information on an amplitude of a first acoustic sub-event of said one of said plurality of ticking acoustic events, and time delay information on a time delay between a first acoustic sub-event of said one of said plurality of ticking acoustic events and a second acoustic sub-event of said one of said plurality of ticking acoustic events, wherein the method is performed on the electrical signal comprising only every other ticking acoustic event.

11. The method of claim 10, further comprising storing the identification code in a storage system.

12. A method for generating an identifier for a timepiece, the method comprising executing on a processor of a computing device a computer program code, the computing device further comprising a memory storing a program control configured to control a measuring module, an extraction module, an identification module, a comparison module and an authenticity determination module that are implemented as separate or combined modules in the computing device, to perform the steps of:

measuring by the measuring module acoustic vibrations emitted by an escapement of a mechanical movement of said timepiece using a microphone to obtain an electrical signal, wherein said electrical signal comprises a plurality of ticking acoustic events associated with mechanical shocks taking place in said timepiece caused by a gear train of the mechanical movement stopping at escapement locks of the escapement;

separating every other ticking acoustic event in said electrical signal;

extracting by the extraction module from the electrical signal at least one of: magnitude information on a magnitude of one of said plurality of ticking acoustic events, time information on said one of said plurality of ticking acoustic events, and frequency information on a frequency of said one of said plurality of ticking acoustic events;

creating by the identification module the identifier comprising an identification code based on said at least one of the magnitude information, the time information and the frequency information, wherein the identification code is utilizable to identify the timepiece as being authentic through:

a comparison by the comparison module of the identification code with at least one stored identification code: and providing by the authenticity determination module an indication of authenticity comprising issuing a signal indicating authenticity when the comparison indicates authenticity, and providing an indication of non-authenticity comprising issuing a signal indicating non-authenticity when the comparison indicates non-authenticity, wherein said extracting comprises extracting, in a time sequence of said electrical signal corresponding to one of said plurality of ticking acoustic events, at least one of:

amplitude information on an amplitude of a first acoustic sub-event of said one of said plurality of ticking acoustic events, and time delay information on a time delay between a first acoustic sub-event of said one of said plurality of ticking acoustic events and a second acoustic sub-event of said one of said plurality of ticking acoustic events, wherein the method is performed on the electrical signal comprising only every other ticking acoustic event.

13. The method of claim 12, wherein the measured acoustic vibrations of the plurality of ticking acoustic events emitted by said timepiece comprise a plurality of consecutive tics and tocks.

* * * * *